US006497326B1

(12) United States Patent
Osawa

(10) Patent No.: US 6,497,326 B1
(45) Date of Patent: Dec. 24, 2002

(54) GOODS DISPLAY UNIT

(75) Inventor: Shinichi Osawa, Tokyo (JP)

(73) Assignee: Kawajun Co., Ltd., Tokyo (JP)

( * ) Notice: Subject to any disclaimer, the term of this patent is extended or adjusted under 35 U.S.C. 154(b) by 0 days.

(21) Appl. No.: 09/555,373

(22) PCT Filed: Nov. 19, 1998

(86) PCT No.: PCT/JP98/05231

§ 371 (c)(1),
(2), (4) Date: May 30, 2000

(87) PCT Pub. No.: WO99/27825

PCT Pub. Date: Jun. 10, 1999

(30) Foreign Application Priority Data

| | | |
|---|---|---|
| Nov. 28, 1997 | (JP) | 9-344439 |
| Jun. 16, 1998 | (JP) | 10-168655 |
| Jun. 23, 1998 | (JP) | 10-175888 |
| Jun. 23, 1998 | (JP) | 10-175893 |

(51) Int. Cl.[7] ..... A47F 1/04
(52) U.S. Cl. ..... 211/59.2; 414/276
(58) Field of Search ..... 211/59.2, 59.3, 211/151, 162, 175, 49.1; 312/42, 45, 71; 193/35 R, 35 C, 33, 34, 2 R; 414/276

(56) References Cited

U.S. PATENT DOCUMENTS

| | | | | |
|---|---|---|---|---|
| 2,218,444 A | * | 10/1940 | Vineyard | 211/59.2 |
| 2,964,154 A | * | 12/1960 | Erickson | 211/59.2 |
| 3,220,527 A | * | 11/1965 | Curtis | 193/35 R |
| 4,685,574 A | * | 8/1987 | Young et al. | 211/59.2 |
| 5,097,962 A | * | 3/1992 | Eklof et al. | 211/59.2 |
| RE33,913 E | * | 5/1992 | Kral et al. | 211/59.2 |
| 5,115,920 A | * | 5/1992 | Tipton et al. | 211/59.2 |
| 5,788,090 A | * | 8/1998 | Kajiwara | 211/59.2 |
| 5,887,732 A | * | 3/1999 | Zimmer et al. | 211/59.2 |
| 5,951,228 A | * | 9/1999 | Pfeiffer et al. | 414/276 |

* cited by examiner

*Primary Examiner*—Daniel P. Stodola
*Assistant Examiner*—Jennifer E. Novosad
(74) *Attorney, Agent, or Firm*—Oblon, Spivak, McClelland, Maier & Neustadt, P.C.

(57) ABSTRACT

A commodity display unit has at least two forward delivery rail frames, each having a plurality of rollers mounted thereon and inclined downwardly. There are at least two side panel sections, one of each being disposed in a middle portion of each of the rail frames and configured to guide therebetween a plurality of commodities over a space separating two adjacent rail frames. There are also at least two end plates, one of each being disposed on each of the side panel sections and being positioned at a rear part of the rail frames. A distance between two adjacent side panel sections may be adjusted to accommodate a width of the plurality of commodities being guided therebetween over the space separating the two adjacent rail frames by moving at least one of the two adjacent rail frames laterally towards or away from the other of the two adjacent rail frames.

10 Claims, 20 Drawing Sheets

GOODS DISPLAY UNIT

BACKGROUND OF THE INVENTION

1. Field of the Invention

This invention relates to a commodity display unit to be placed on display shelves in a shop when used and to enable the commodities involved to be advanced to the front side thereof.

2. Technical Background

Conventionally, in a mass sales store such as a supermarket or drugstore, various kinds of commodities are plentifully displayed on each display shelf in a commodity display case 50 shown in FIG. 27, where the commodities start to sell from the front displayed ones and inevitably it gives rise to an air space in the front section and results in needing what is called the commodity-advancing work of moving the deeply placed commodities forward. Hence, there are presented lots of commodity display shelves or devices each provided with an automatic or semiautomatic commodity-advancing function. For example, there exists a displayed commodity take-out unit 51 having a number of rotating rollers mounted in the form of sloping downward and frontward on the bottom of a commodity display case (Japanese Laid-Open Patent Publication No. 8-24091).

However, in the displayed commodity take-out unit 51, both the side panels 52*a* and 52*b* each provided with a function of separating the commodities are fixedly disposed thereon opposite to each other; the unit 51 can display such a commodity suited for the width between the side panels; however, a commodity having a larger size than the width needs a different unit suitable for its own size. Accordingly, it is necessary to sort various kinds of commodity take-out units, and it causes such a problem that the inventory management or the like becomes complicated. Also, because the rotating rollers mounted in the form of sloping downward and frontward on the bottom of the commodity display case are laid on the whole surface of the bottom, there is a problem of inevitably increasing the manufacturing cost.

Accordingly, an object of the present invention is to provide an inexpensive and adjustable commodity display unit easy to use in inventory management, readily changeable in design in compliance with the size of the commodity to be displayed, and allowing the rotating rollers to be thinned out.

Another object of the present invention is to provide a commodity display unit enabling the commodities therein to be smoothly and automatically advanced to the front side of the unit, wherein the partition panel for each commodity is freely adjustable in conformity with the width of the commodity and even a commodity with a higher center of gravity is prevented from falling frontward.

Under such circumstances, the inventor has reached the completion of the present invention by discovering the following as a result of energetic investigations: a frontal advancing device for each commodity is formed by using a forward delivery rail frame provided with such a side panel in the middle position of the frame as to provide a partition along one side of the commodity; there is prepared a positioning and fixing device designed to determine a distance between the partition panels and to connect the frontal advancing devices to each other for positioning and fixing; thus, a commodity display unit united into one body is obtained by providing the frontal advancing device with the positioning and fixing device, or else another commodity display unit as a combination is obtained by employing the frontal advancing device and the positioning and fixing device separately; therefore, a distance between the partition panels can be set without restraint according to the size of the commodity; also, such commodity display units each united into one body may be added to the thus obtained units in sequence in conformity with the number of the kinds of commodities; and then there is no more need to store lots of commodity display units for the various kinds of commodities and positioning and fixing devices different in size for inventory management.

In other words, the present invention provides a commodity display unit which comprises a forward delivery rail frame having lots of rollers mounted on the rail frame in the form of descending frontward, and a side panel section detachably or undetachably formed in the middle portion of the rail frame for guiding the commodities; wherein two or more of the rail frames are used as a combination in the commodity display unit; a commodity fall-down preventing section is installed in the front section of a commodity display shelf; a pitch-fixing plate is provided for positioning the forward delivery rail frame; and, wherein a distance between the side panels suitable for the size of the commodity is set without restraint by selecting a pitch of the pitch fixing plate along with combining the two or more forward delivery rail frames with one another. On the basis of such a constitution, two or more of the forward delivery rail frames are appropriately combined with one another for forming a commodity display space suitable for the size of the commodities to be displayed, and juxtaposed in the form of sloping downward and frontward.

According to this arrangement, the side panel of one forward delivery rail frame provides a partition along one side of the commodity; the side panel of another forward delivery rail frame provides a partition along the other side of the commodity; and hence the two rail frames enable a column of the commodities to be frontally advanced in the form of being displayed. Also, such a display unit is easy in inventory management and readily changeable in design. As for a commodity never needing to contact the rollers in the middle portion between the side panels, e.g., a canned product having a broad bottom, the two forward delivery rail frames can be separately installed, and it is possible to thin out the rotating rollers, thus rendering the resultant commodity display unit inexpensive.

Also, the present invention provides a commodity display unit having a forward delivery rail frame with lots of rollers mounted on the rail frame in the form of descending frontward, and a side panel section detachably or undetachably formed in the middle portion of the rail frame for guiding the commodities; wherein two or more of the forward delivery rail frames are used as a combination in the commodity display unit; a commodity fall-down preventing section is installed in the front section of a commodity display shelf; there is a slide plate for positioning the rail frame; a distance between the side panels suitable for the size of the commodity is set without restraint by selecting an engagement position of the slide plate for positioning along with combining the two or more rail frames with one another. Such a constitution makes it possible to adjust delicately the width between the partitions for the commodities while leaving the commodities as they are.

Also, the present invention provides a commodity display unit having a forward delivery rail frame with lots of rollers mounted on the rail frame in the form of descending frontward, a side panel section detachably or undetachably formed in the middle portion of the rail frame for guiding the commodities, and an engagement projection which is disposed at the front end of the rail frame; two or more of the rail frames are used as a combination in the commodity display unit; a commodity fall-down preventing section has an engagement groove for engaging with the engagement projection and is installed in the front section of a commodity display shelf; a distance between the side panels suitable for the size of the commodity is set without restraint by selecting an engagement position of the commodity fall-down preventing section along with combining the two or more forward delivery rail frames with one another. By using such a constitution, the present invention has the advantages similar to those of the invention without using a pitch fixing plate for positioning.

Also, the present invention is directed to a commodity display unit wherein the forward delivery rail frame is fitted with the pitch-fixing plate for positioning and forming one united body thereof. According to such a constitution, the forward delivery rail frames can be connected to one another and positioned based on a size of the commodity by using the pitch fixing plate for positioning them united with the forward delivery rail frame; the resultant connected frames as they stand can be mounted on the commodity display shelf in such a manner as to direct one side of the rail frame, the one side positioned in a commodity take-out section, to the door side of the commodity display shelf; the commodities, when placed on the frame, automatically move frontward to the one side positioned in the commodity take-out section via the rollers; and then the design over the commodity display shelf can be shifted irrespective of the size of the commodity or its display shelf.

Also, the present invention is directed to a commodity display unit wherein the slide plate for positioning the rail frame is provided in the forward delivery rail frame to form one united body. By employing this constitution, the invention of this feature has the advantages similar to those of the previously described embodiment.

Again, the present invention is directed to a commodity display unit further having a forward delivery rail frame with lots of rollers mounted thereon in the form of sloping down frontwardly and a side panel, for guiding the commodities, formed detachably or undetachably at one side end portion of the rail frame. By employing this constitution, the invention has, besides the advantages similar to those of earlier described embodiments, the ability to eliminate dead spaces in the display space and hence fully utilize the display area when the forward delivery rail frames with the side panels as above are used in such a manner that the side panels are positioned at the side ends of the display shelf.

Likewise, the present invention is directed to a commodity display unit wherein the commodity fall-down preventing section has an engagement groove holding detachably a commodity fall-down preventing panel. According to such a constitution, the invention is provided with the ability to fit the commodity fall-down preventing panel conformable to the size, weight or the like of the commodity into the groove, to prevent the commodities from surely falling down, and to make the commodity display shelf safe and attractive, in addition to the advantages similar to those described earlier.

Also, the present invention is directed to a commodity display unit wherein the state where the rollers slope down and frontward is obtained by mounting nearly horizontally the rollers on the forward delivery rail frames and by sloping down the rail frames toward a commodity take-out section. By using such a constitution, the present invention has, besides the advantages similar to those of other embodiments, the ability to set freely the angle of inclination of the rollers in compliance with the condition of the commodities, and hence, when the thus set rail frames are mounted on the commodity display shelf as they are, the commodities on the rollers can be moved toward the commodity take-out section side, conformably to the conditions involved, by the component of force constantly applied to the commodities.

Also, the present invention is directed to a commodity display unit wherein the rollers are replaced with a slide material. According to a use of such a constitution, the commodity display unit can have a wider variation and increase room for the selection in changing the design thereof, in addition to the advantages similar to those discussed above.

Then, the present invention is directed to a commodity display unit wherein the forward delivery rail frames are positioned together by forming a width adjustment spacer corresponding to a width of at least one commodity in the end portion of the side panel, the end portion being positioned in the commodity take-out section of the rail frame. Such a constitution results in, besides presenting the advantages similar to those mentioned previously, conducting the most suitable positioning for taking out the commodities smoothly and automatically by lightly pressing the width adjustment spacer formed as above for the commodity to thereby determine a distance between the side panels and by only connecting the commodity forward delivery rail frames to one another as they stand by the positioning and fixing device.

The symbols in the figures denote as follow: (1*a*) to (1*n*) are each a frontal advancing frame; (2) is a fall-down preventing panel; (3) is a positioning pitch fixing plate; (3*a*) is a positioning slide fixing plate; (10), (101*a*) to (101*e*) are each a commodity display unit; (11) is a roller, (15) is a side panel; and (19) is an outside frame.

BEST MODE FOR CARRYING OUT THE INVENTION

Figure 1:
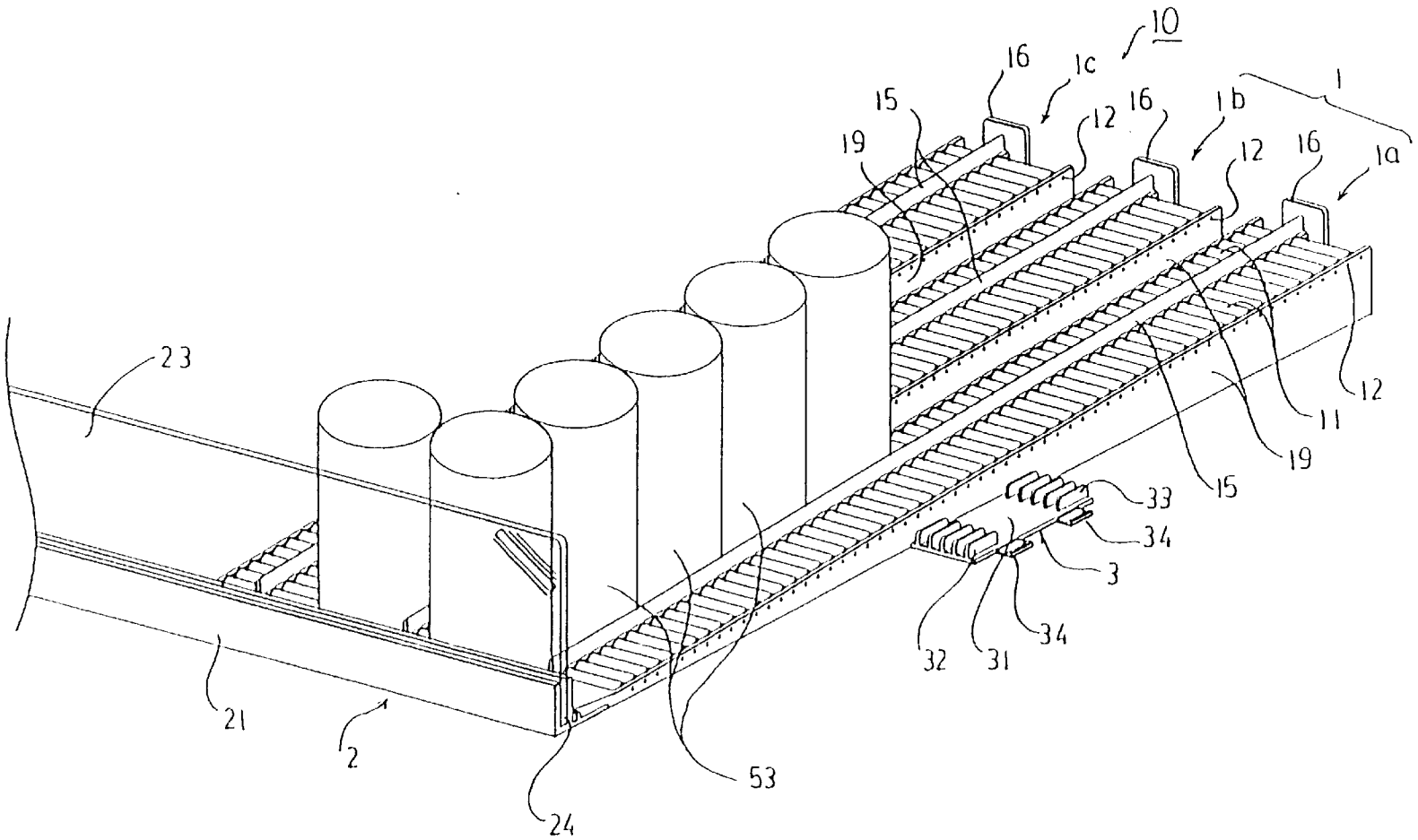
FIG. 1 is a perspective view showing the using state of a commodity display unit in an embodiment according to the present invention.
Figure 2:
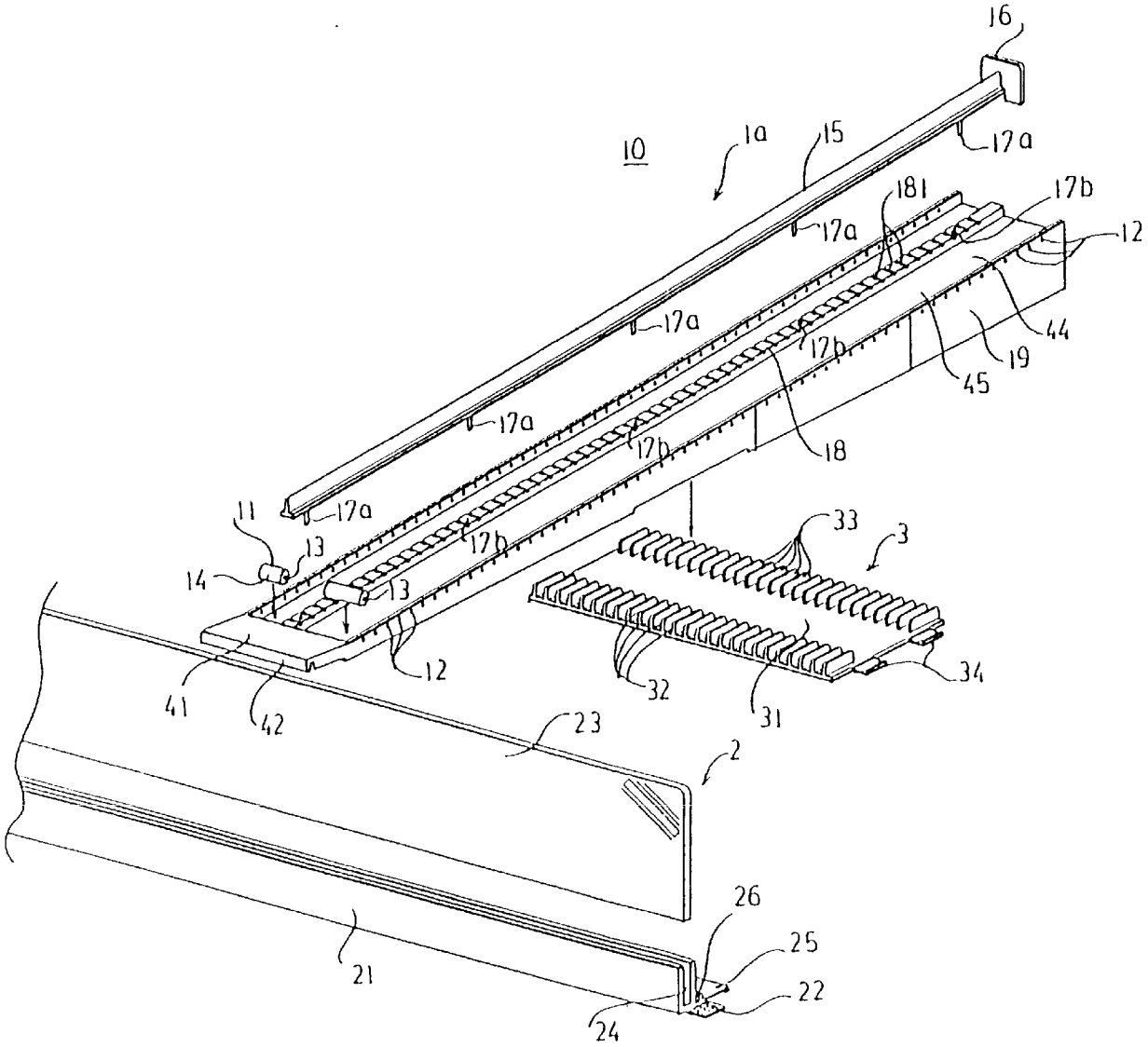
FIG. 2 is an exploded view of the commodity display unit of FIG. 1.

Referring to FIGS. 1 and 2, a commodity display unit in an embodiment according to the present invention will be explained hereinafter. FIG. 1 is a perspective view showing the using state of the commodity display unit in a first embodiment, and FIG. 2 is a perspective view wherein the respective components of the commodity display unit in FIG. 1 are disassembled. The commodity display unit 10 comprises a pair of forward delivery rail frames 1*a* and 1*b*, a pitch fixing plate 3 for positioning, and a commodity fall-down preventing section 2. The forward delivery rail frame 1*a* comprises: a main body section 44 where a roller mounting section 45 is separated into two sections by both right-and-left outside frames 19 each made of thin plate and by a side panel 15 supported by an outer frame and positioned in the middle portion of the section 45; and a front section 41 having an engagement projection 42 at its end, thus as a whole sloping down frontward to shape as a result what is called a playground slide. On a side panel support 18, nearly cylindrical bearing holes 181 are laid from the upper end of the support 18 at predetermined intervals, and also engagement holes 17*b* for engaging with engagement portions 17*a* of the side panel 15 are formed at predetermined intervals. The side panel 15 having an inverted T-shaped cross section is provided with an end plate 16 at the rear end thereof for aiding in fitting the side panel 15 into the side panel support 18 and with five pieces of engagement portions 17*a* on the reverse side thereof, at predetermined intervals. The side panel 15 has a function of providing a partition along each side of the commodities on display and also a function as a restraint plate for restraining roller shafts 13 from bouncing out.

Lots of rollers 11 so rotatably formed as to slide the commodities 53 forward are disposed on the roller mounting section 45. A roller 11 comprises a roller main body 14 and the roller shafts 13 disposed on both sides of the ma body 14 and smaller in diameter than the body 14, and two sections of disposed roller groups are provided by pivotally supporting the roller shafts 13 with the aid of shaft holes 12 formed in the right-and-left outside frames 19 and 19 and of the bearing holes 181. After the rollers are disposed, the slide panels 15 are fitted into the side panel support 18, which produces the groups of lots of rollers laid rotatably-in the form of sloping down frontward.

The pitch fixing plate 3 for positioning comprises a front projection section 32 and a rear projection section 33 obtained by juxtaposing numerous projections on a flat base plate 31 along right-and-left positions. There are produced the grooves corresponding to the portions (pitches) between the adjoining projections, and by inserting the outside frames 19 into the grooves, the frontal advancing rail frame is secured thereto. Also, one end portion of the base plate 31 is fitted with connecting hands 34 for connecting with another pitch fixing plate 3 for positioning, which makes it possible to comply with display shelves with a variety of width lengths.

The commodity fall-down preventing section 2 designed to be installed in the front section of the commodity display shelf, comprises: a commodity fall-down preventing main section 21 having an engagement groove 24 adapted to be detachably engaged with a commodity fall-down preventing panel 23; a magnet sheet affixed to the reverse surface of the main section 21 for fixing the preventing section 2 to the display shelf; a tongue-shaped contact 25 extending from the bottom of the main section 21 backward and contacting with the front section 41 of the rail frame; and an engagement groove 26 adjacent to the engagement groove 24 and engaging with an engagement projection 42 of the rail frame. The preventing plate 23 is made of transparent oblong acrylic resin plate material and detachably supported by the engagement groove 24.

The usage method of the commodity display unit 10 formed as above is described next. There are prepared two frontal advancing rail frames 1*a* and 1*b* each of which is provided with a roller group of numerous rollers rotatably mounted thereon in the form of sloping down frontward and with the side panel disposed in the middle thereof. Then, the pitch fixing plates 3 for positioning are juxtaposed in the about middle portion of a display shelf board in conformity with the display width. By making a combination of the two frontal advancing rail frames 1*a* and 1*b* and selecting the pitch grooves of the pitch fixing plates, 3 the distance between the side plates fit for the commodity to be displayed is determined, thus fixing the rail frames to the plates 3. Next, the commodity fall-down preventing panel 23 has only to be engaged with the engagement groove 24. In the case of fitting the engagement projections 42 of the frontal advancing rail frames 1*a* and 1*b* the engagement groove 26, the whole of the assembled unit can be rendered strong and fixed stably to the display shelf. In FIG. 1, furthermore, by employing another frontal advancing rail frame 1*c*, the three frontal advancing rail frames 1*a*, 1*b*, and 1*c* are prepared and assembled so as to advancing the commodity from the forefront of the two columns of commodities. In the embodiment of the present invention having such a constitution, the side panel of one frontal advancing rail frame serves to provide a partition along one side of one column of commodities and the side panel of the other frontal advancing rail frame serves to provide a partition along the other side of the one column of commodities, and hence the two frontal advancing rail frames enable one column of commodities to be advanced from the front side as they remains in the form of being displayed. Also, the display unit of the embodiment is easy in inventory management, and the design change is readily carried out according to e.g. size of the commodity to be displayed. As for a commodity never needing to contact with the rollers in the middle portion between the side panels, e.g., a canned product having its broad bottom, the two rail frames can be separately installed so that the rotating rollers are capable of being thinned out to thereby render the display unit inexpensive. Furthermore, it is possible to set the commodity fall-down preventing panel conformable to the size, weight or the like of the commodity to be displayed, which can surely prevent any commodity from falling down and render the display unit safe and pleasing in appearance.

Figure 3:
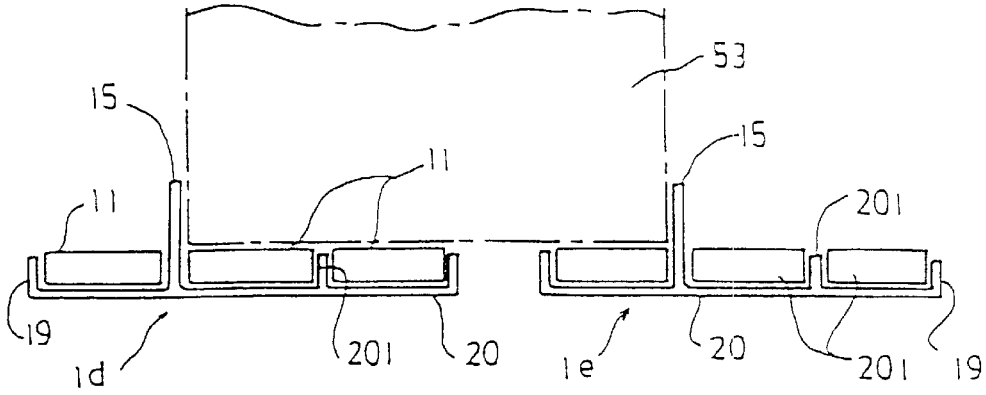
FIG. 3 is a view schematically showing a cross section of a forward delivery rail frame used in an embodiment according to the present invention.
Figure 4:
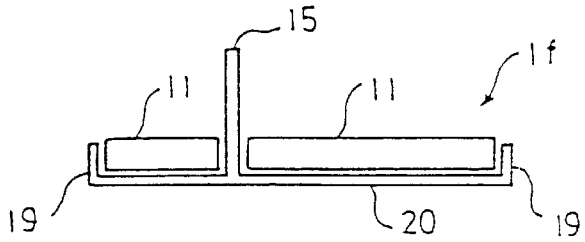
FIG. 4 is a view schematically showing a cross section of a forward delivery rail frame used in another embodiment according to the present invention.
Figure 5:
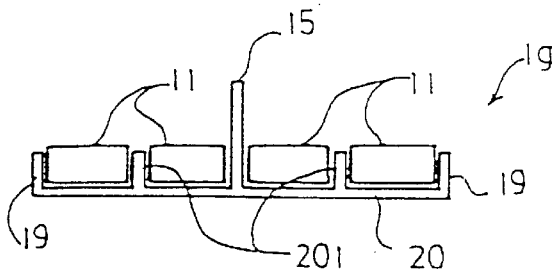
FIG. 5 is a view schematically showing a cross section of a forward delivery rail frame used in another embodiment according to the present invention.
Figure 6:
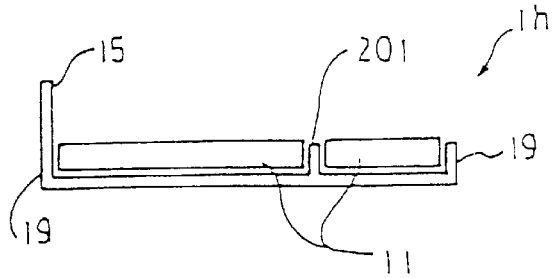
FIG. 6 is a view schematically showing a cross section of a forward delivery rail frame used in another embodiment according to the present invention.

In the frontal advancing rail frame, positional relations of the roller mounting section thereon and the side panel positioned in the middle portion thereof are never limited and infinite in number, for example, those of FIG. 3 through FIG. 5 are shown. A positional relation of the roller mounting section and the side panel disposed on one side end of the rail frame is depicted in FIG. 6. FIG. 3 through FIG. 6 are each a view schematically illustrating a cross section of the frontal advancing rail frame. In FIG. 3, the numbers 11, 20, 201, and 19 denote the roller, the frontal advancing rail frame main body, a roller supporting plate, and the outside frame of the frame, respectively. The frontal advancing rail frames 1*d* and 1*e* each comprises the side panel 15 deviated slightly to the left from the middle portion, a single column of rollers laid on the left side of the middle portion, and two columns of rollers laid on the right side of the middle portion while sandwiching the roller supporting plate 201 therebetween, and the thus obtained frames 1*d* and 1*e* are combined a little separately for receiving the commodity 53 thereon.

As for FIG. 4, the same components as those of FIG. 3 are shown by the same symbols and omitted in explanation, and then only the difference therebetween is described. Namely, in the frontal advancing rail frame 1*f* of FIG. 4, what is different from that of FIG. 3 is that a combination of the two frames is omitted so as to schematically illustrate one frame only and the roller group on the right side of the side panel 15 is formed into a single column of rollers.

As for FIG. 5, the same components as those of FIG. 3 are shown by the same symbols and omitted in explanation, and then only the difference therebetween is described. Namely, in the frontal advancing rail frame 1*g* of FIG. 5, what is different from that of FIG. 3 is that a combination of the two frames is omitted so as to schematically illustrate one frame only; the side frame t5 is formed in the middle; and two columns of rollers are each laid on each of the right-and-left sides of the side frame 15 while sandwiching the roller supporting plate 201 therebetween.

As for FIG. 6, the same components as those of FIG. 3 are shown by the same symbols and omitted in explanation, and then only the difference therebetween is described. Namely, the frame of FIG. 6 is designed to be applied on both the right-and-left ends of the display shelf, wherein the side panel 15 is formed on one outside frame 19 of the rail frame. When such a frame is combined with any frontal advancing frame depicted in FIG. 3 through FIG. 5 each having the side panel in the middle, then the display area on the display shelf can be efficiently utilized.

Figure 7:
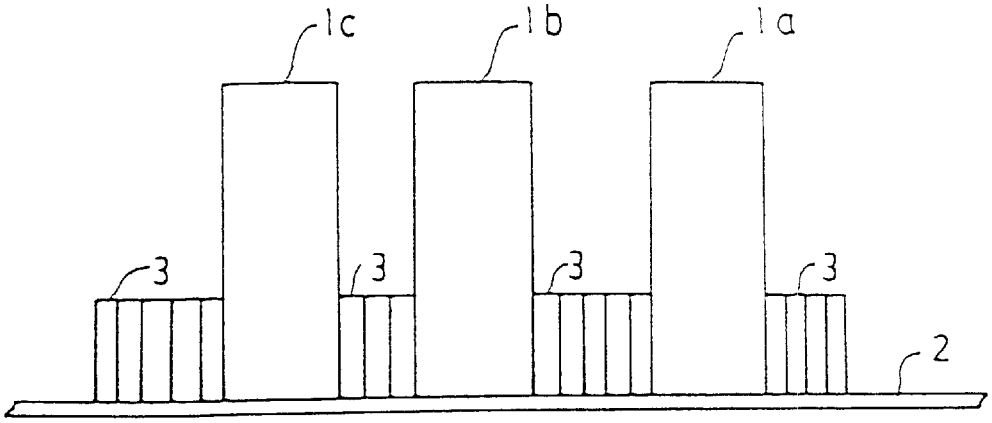
FIG. 7 is a view schematically showing a plan view of the using state of a commodity display unit according to the present invention.
Figure 8:
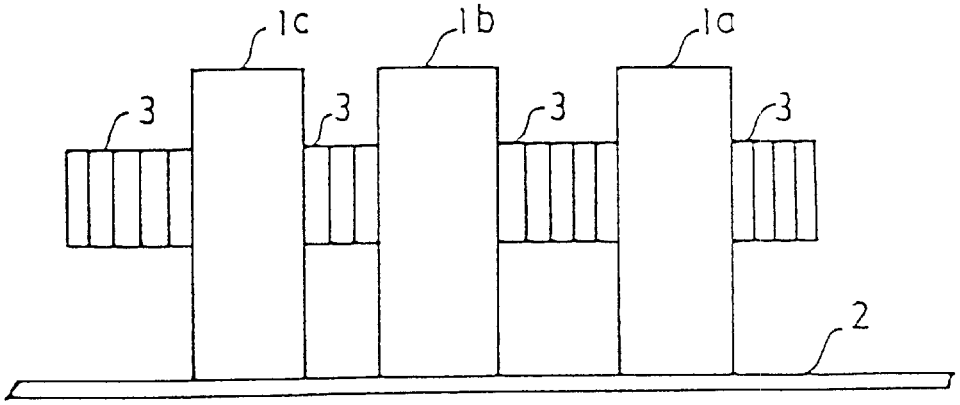
FIG. 8 is a view schematically showing a plan view of the using state of a commodity display unit according to the present invention.
Figure 9:
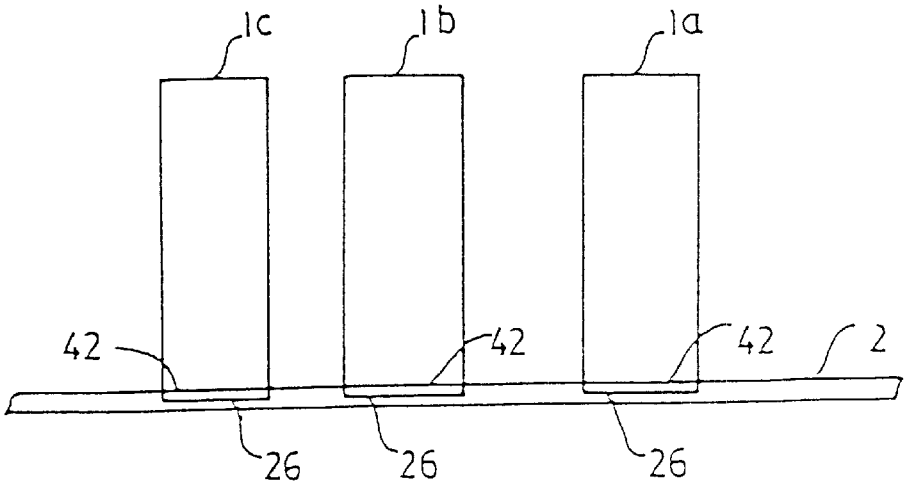
FIG. 9 is a view schematically showing a plan view of the using state of a commodity display unit according to the present invention.
Figure 10:
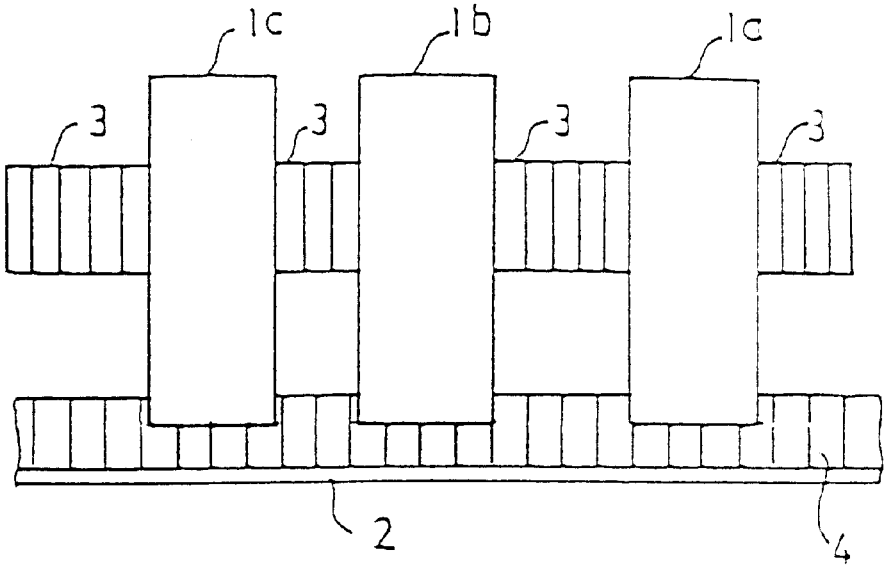
FIG. 10 is a view schematically showing a plan view of the using state of a commodity display unit according to the present invention.
Figure 11:
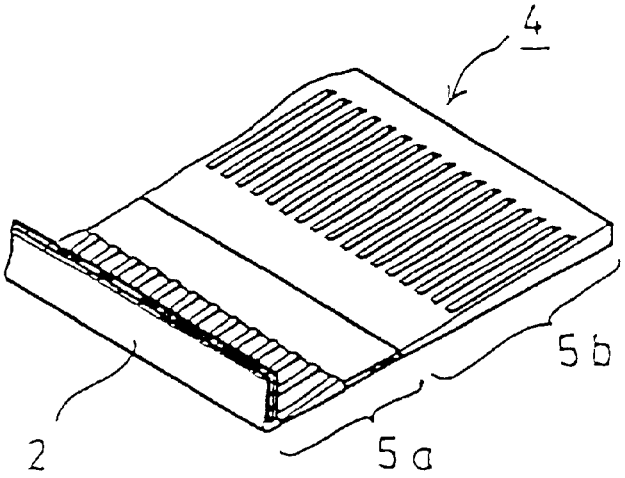
FIG. 11 is a perspective view showing part of a pitch-fixing plate for size adjustment used in the fixing state in FIG. 10.

As an aspect where the at least two frontal advancing frames 1, and the pitch fixing plate 3 for positioning or the front engagement relations 42 and 26 are combined to be fixed to one another, those shown in FIG. 7 through FIG. 10 are indicated. FIG. 7 through FIG. 10 are views each schematically showing a plane view in which the commodity display unit of the present invention is in the using state. Also, FIG. 7 illustrates an aspect where the front sections of three frontal advancing frames 1*a*, 1*b*, and 1*c* are fixed by a pitch fixing plate 3 for positioning. FIG. 8 illustrates an aspect where the middle sections of three frontal advancing frames 1*a*, 1*b*, and 1*c* are fixed by a pitch fixing plate 3 for positioning. FIG. 9 illustrates an aspect where the three frames 1*a*, 1*b*, and 1*c* are fixed by engaging the engagement projections 42 provided on the front sections of the three rail frames 1*a*, 1*b*, and 1*c* with the engagement groove 26 of the commodity fall-down preventing section. Again, FIG. 10 shows a variation of the embodiment illustrated in FIG. 8, this aspect is enabled to be applied to a deep shelf by engaging a pitch fixing plate 4 for size adjustment with the front section of the frontal advancing frame. That is, FIG. 11 illustrates part of the pitch fixing plate 4 for size adjustment, which comprises; an engagement section 5*b* with which the front sections of the three frames 1*a*, 1*b*, and 1*c* are engaged; an extension section 5*a* slightly descending frontward and having numerous longitudinal grooves at the front part; and the commodity fall-down preventing section 2. This section 2 can be omitted or else employed, and its width length is freely adjusted in the range of that of the frontal advancing frame 1 or so to that of the display shelf. Also, it is thinkable to combine the fixing aspect in FIG. 9 with that in FIG. 7, FIG. 8 or FIG. 10, however, such an aspect is omitted from any view.

Figure 14:
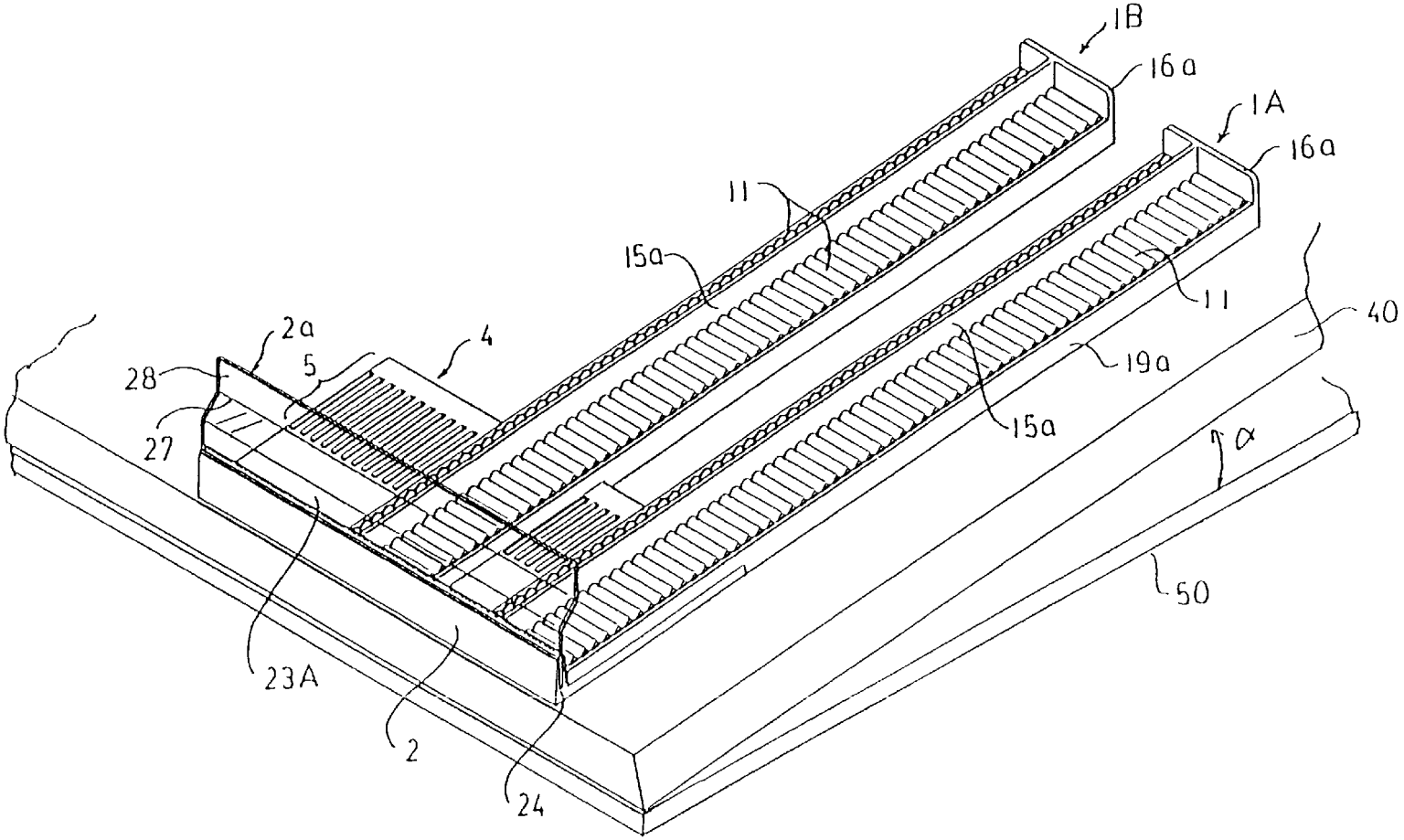
FIG. 14 is a perspective view showing the using state of a commodity display unit of another embodiment according to the present invention.
Figure 15:
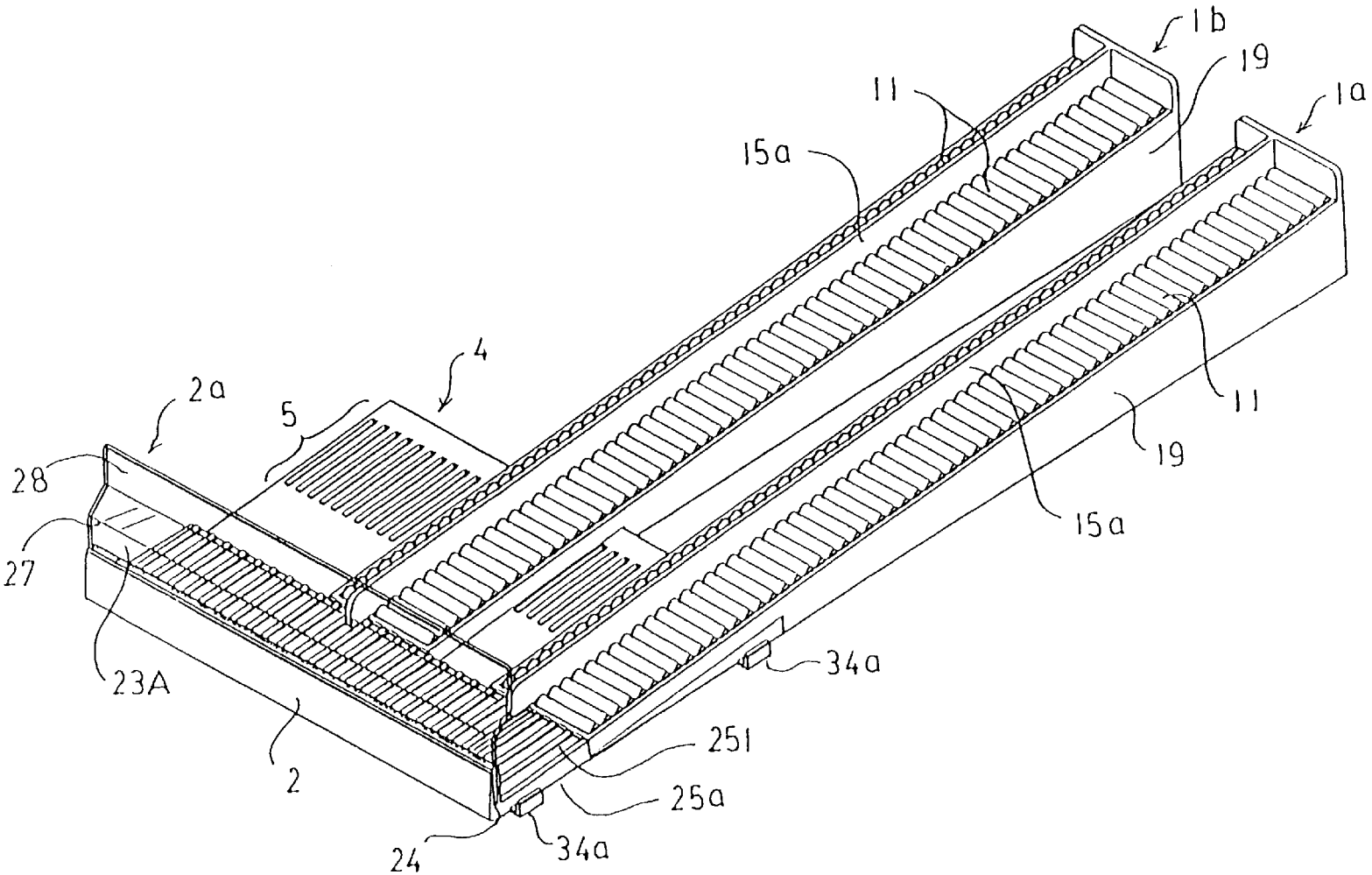
FIG. 15 is a perspective view showing the using state of a commodity display unit of another embodiment according to the present invention.
Figure 16:
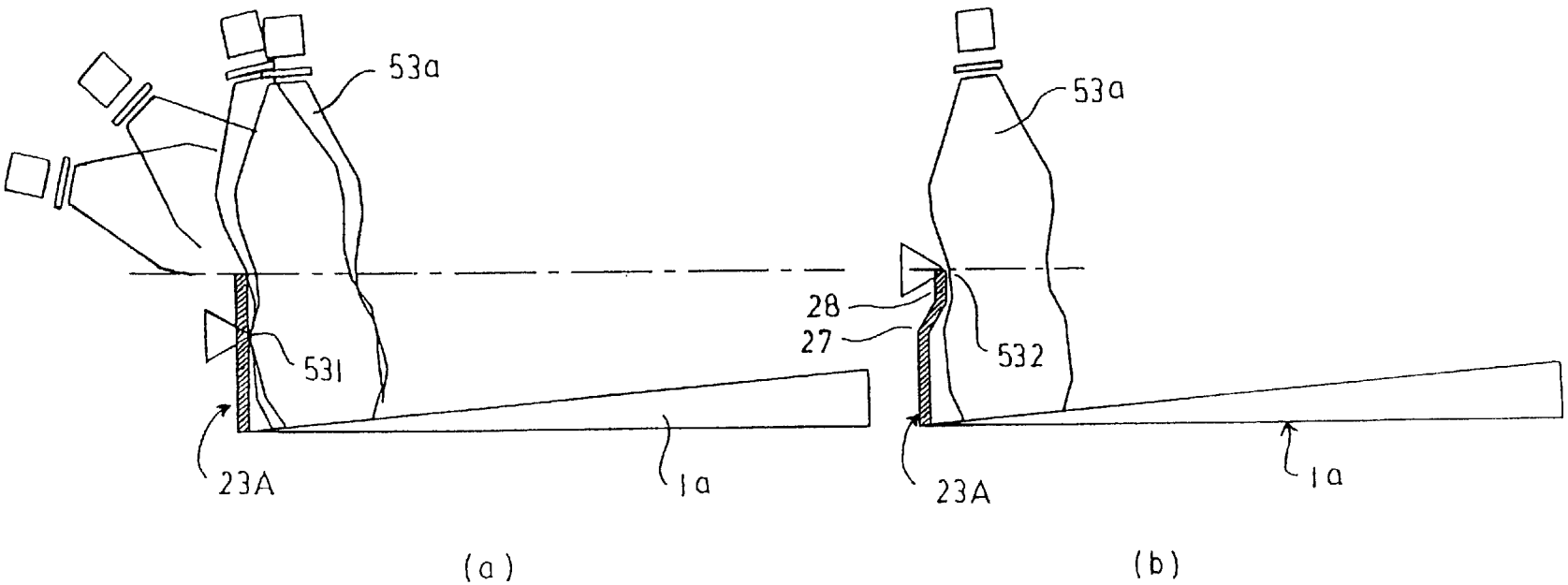
FIG. 16 is a schematic view for explaining the function of a commodity fall-down preventing panel.

Referring to FIG. 12 through FIG. 16, a commodity display unit of another embodiment according to the present invention is explained. FIG. 12 through FIG. 15 are each a perspective view showing the commodity display unit in the using state, and FIG. 16 is a schematic view for explaining the function of the commodity fall-down preventing panel used in FIG. 15.

Figure 12:
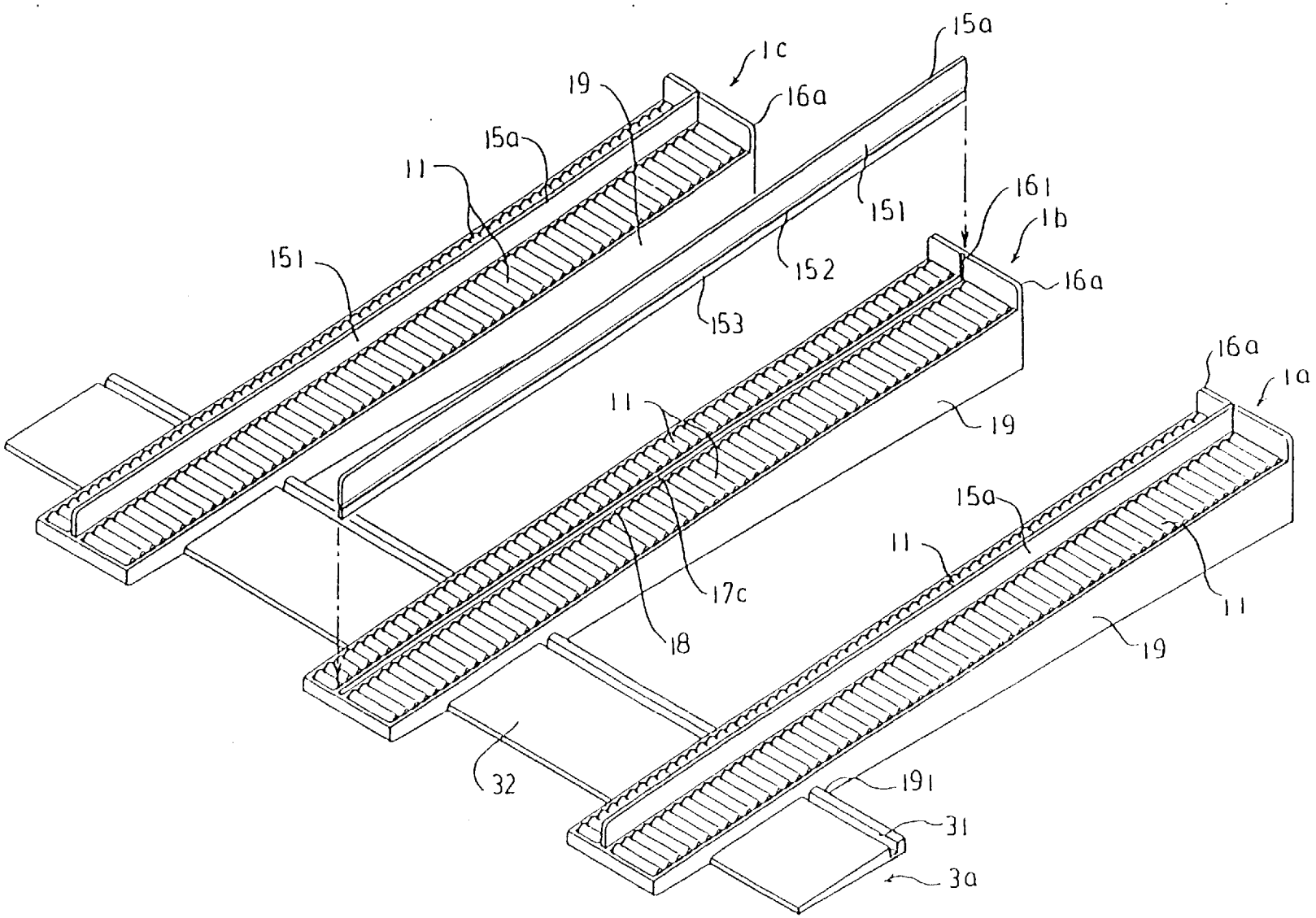
FIG. 12 is a perspective view showing an assembling state of a commodity display unit of another embodiment according to the present invention.
Figure 13:
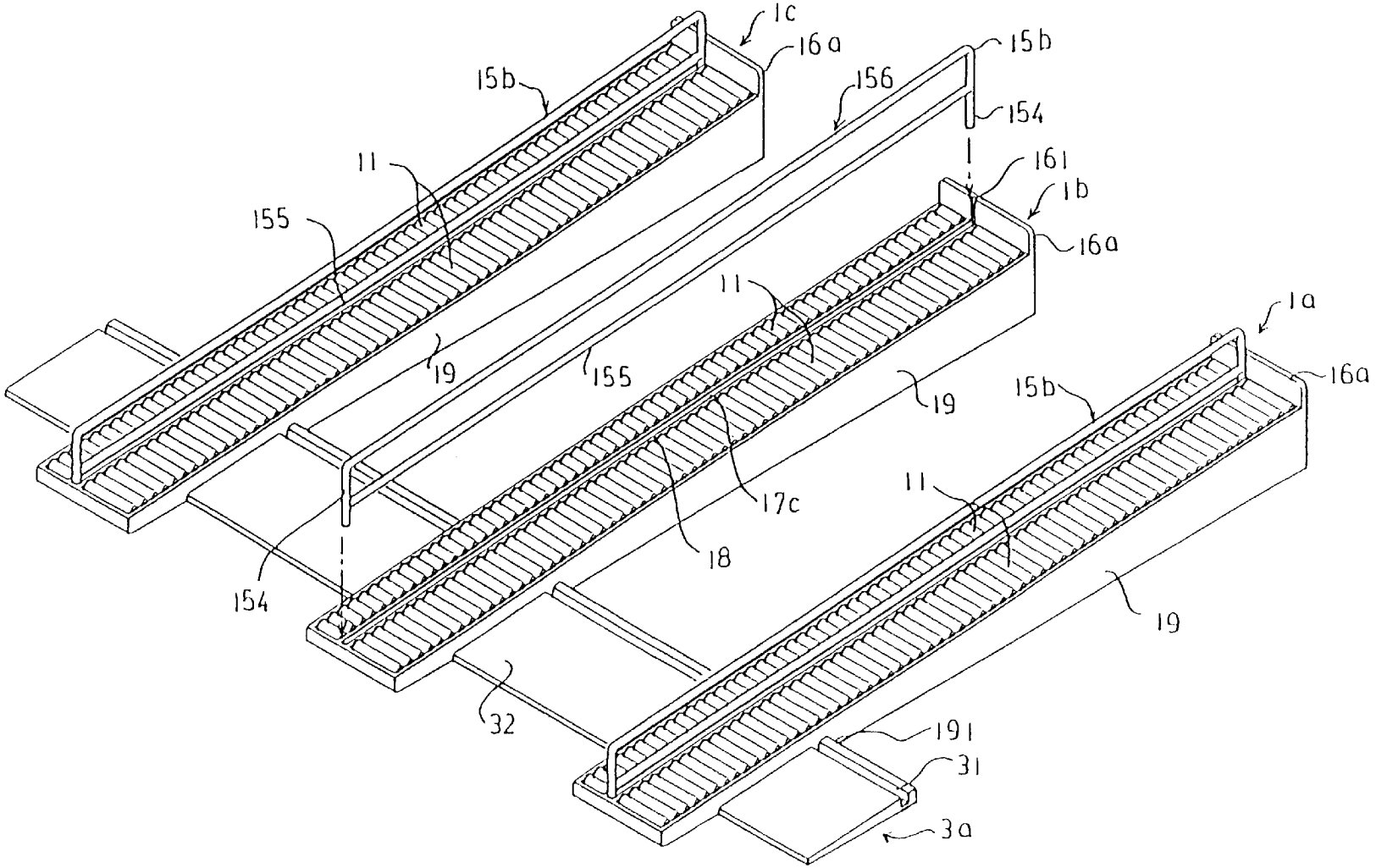
FIG. 13 is a perspective view showing an assembling state of a commodity display unit of another embodiment according to the present invention.

As for FIGS. 12 and 13, the same components as those of FIGS. 1 and 2 are denoted by the same symbols and omitted in explanation, and then only the difference is mainly described next. That is, the main difference in respect of FIG. 12 is that the engagement-type side panel 15 and the pitch fixing plate for positioning are replaced with a detachable plate material 15*a* and a positioning slide plate 3*a* for positioning, respectively. Accordingly, an engagement groove 161 for the plate material 15*a* is provided at the rear portion of the frame main body, and an engagement groove 17*c* for the plate material 15*a* is provided on the side panel support 18. The side panel section of the plate material 15*a* is rectangular and made of resin, wherein an engagement section 153 and a partition section 151 for commodity are separated by a groove 152. A main body 32 of the positioning slide plate 3*a*, having a cuneal cross section, is provided with a groove 81 so as to slide the frontal advancing frames 1*a*, 1*b*, and 1*c* without restraint in the right-and-left direction. Accordingly, the engagement position of the rail frame can be set at any desirable position in accordance with the width of the commodity involved. Also, this commodity display unit, when used, is combined with the commodity fall-down preventing section omitted from the figure. FIG. 13 is the same as FIG. 12 except that the plate material for the side panel in FIG. 12 is replaced with a wire rod 15*b*. The side panel section of the wire rod 15*b*, in the form of U-shape or so, comprises a main body 156, an engagement section 154, and a reinforcement material 155, so as to be detachably fitted into the grooves 161 and 17*c* of the rail frame.

As for FIG. 14, the same components as those of FIGS. 1 and 2 are denoted by the same symbols and omitted in explanation, and then only the difference is mainly described next. Namely, the main difference in FIG. 14 is directed to the shape of the rail frame, the commodity fall-down preventing panel, and the pitch Gag plate for size adjustment. The frontal advancing rail frames 1A and 1B in FIG. 14 are each of thin box-type without any inclination and designed to be placed on a shelf 40 having an angle of inclination $\alpha$ when installed. On the other hand, the commodity fall-down preventing panel 23A comprises an upper section 27 bending toward the commodities, and a contact section 28 to be contacted with the commodities in the upper section 27. In the past, a vertically long PET bottle product 53*a* has been likely to fall down; however, the thus structured panel 23A eliminates the risk of such a fall-down because of contacting with a high point 532 of the product 53*a* (FIG. 16). The pitch fixing plate 4 for size adjustment unitedly formed with the commodity fall-down preventing section conducts the positioning of the frames 1A and 1B.

As for FIG. 15, the same components as those of FIGS. 1 and 2 are denoted by the same symbols and omitted in explanation, and then only the difference is mainly described next. Namely, the main difference in FIG. 15 is directed to the commodity fall-down preventing section. That is, the commodity fall-down preventing section 2 in FIG. 15 comprises the pitch fixing plate 4 for size adjustment, a front side panel engagement groove 25*a* engaging with the side panel 15*a*, and the commodity fall-down preventing panel engagement groove 24. The pitch fixing plate 4 and the engagement groove 25*a* have each a connecting hand 34*a* at its side end. The commodity fall-down preventing panel 23A detachably supported by the commodity fall-down preventing section 2 has the same function as that described above in respect of FIG. 4.

Figure 17:
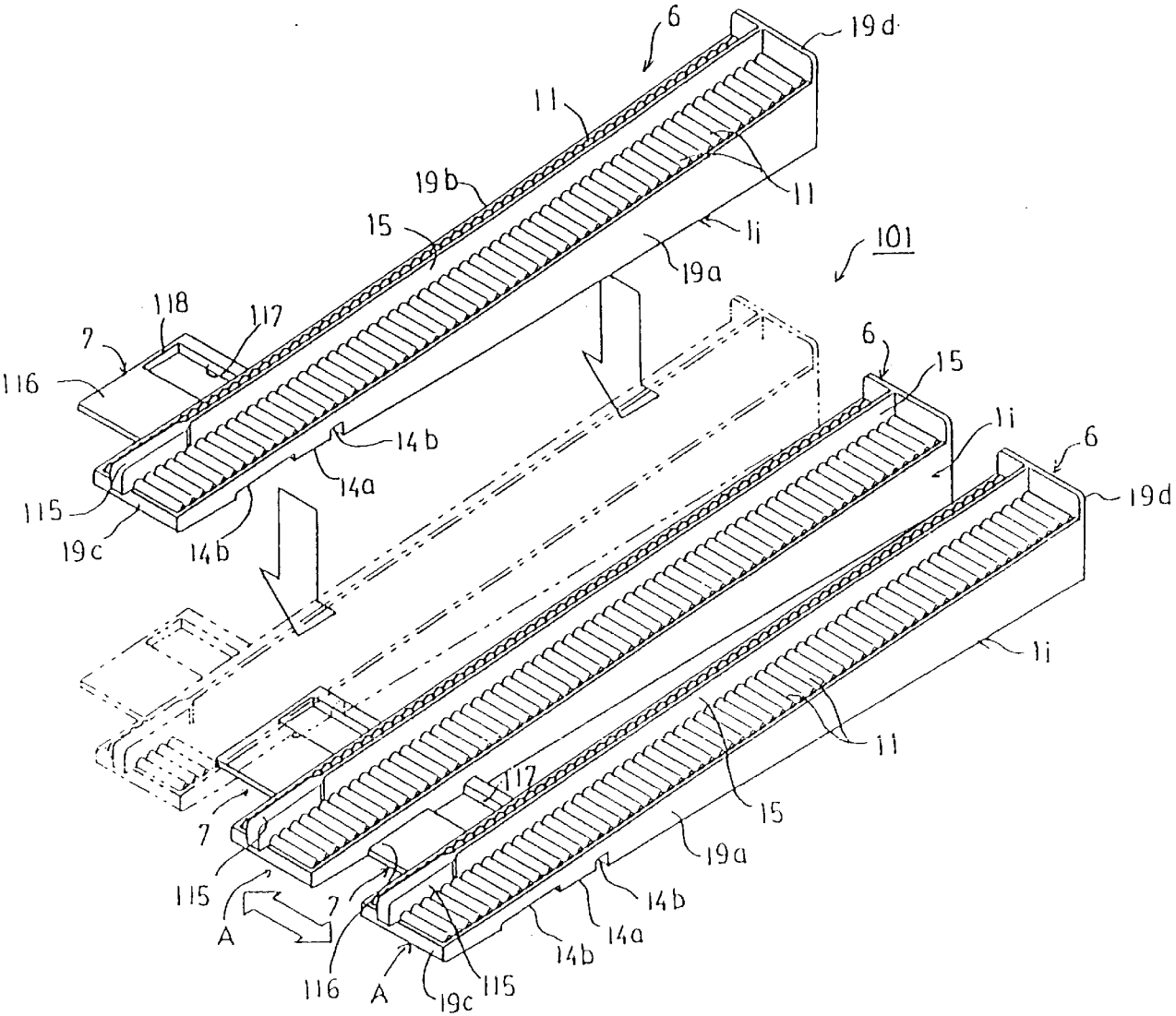
FIG. 17 is a perspective view showing an assembling state of a commodity display unit of another embodiment according to the present invention.
Figure 18:
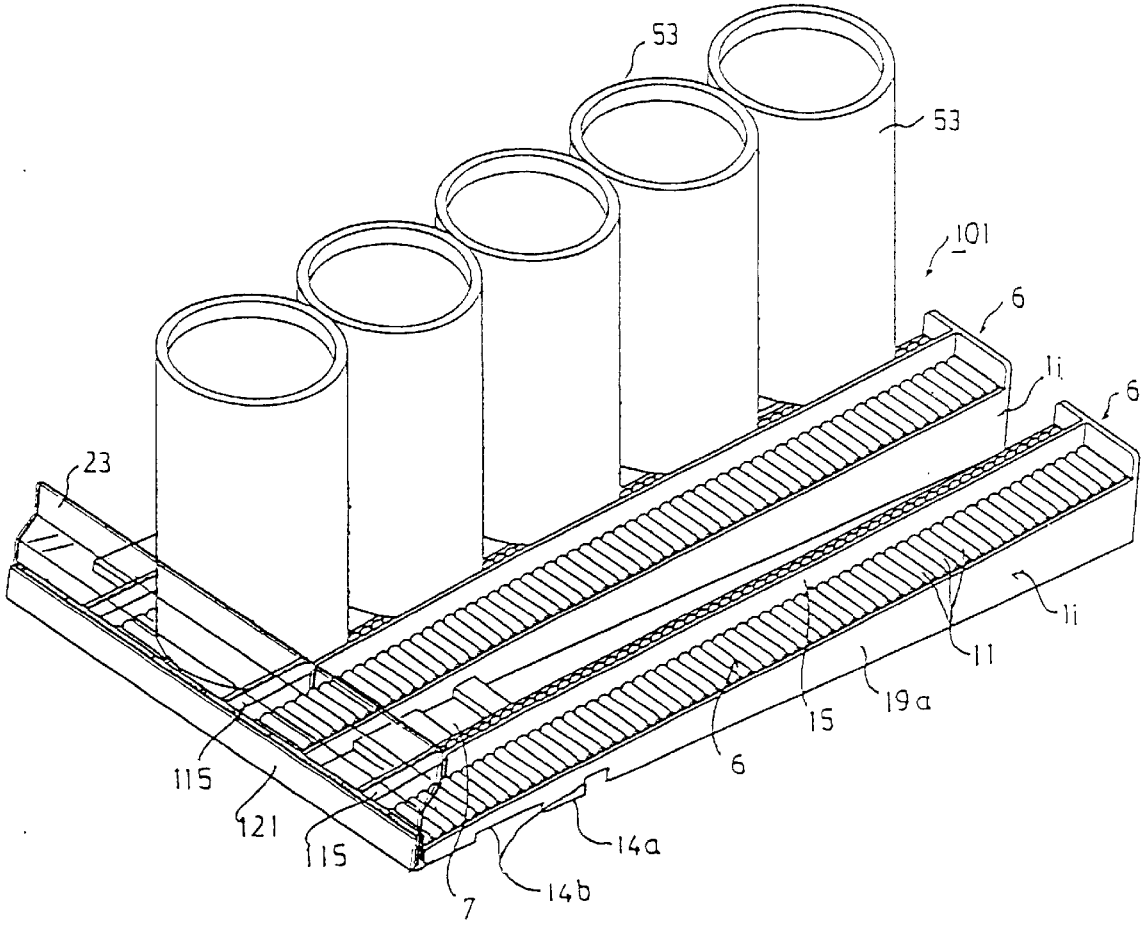
FIG. 18 is a perspective view showing the using state of a commodity display unit of FIG. 17.
Figure 19:
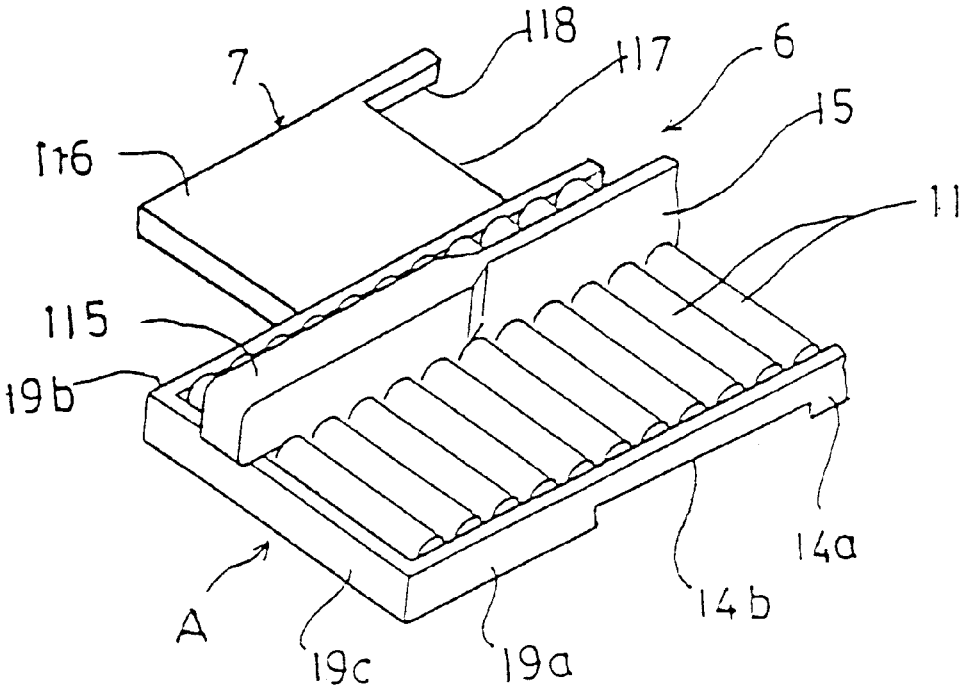
FIG. 19 is a perspective view showing part of a commodity display unit in FIG. 17.

Hereinafter, taking another embodiment, the present invention is described in detail based upon FIG. 17 through FIG. 26. FIG. 17 is a prospective view showing the assembling state of the commodity display unit according to another embodiment; FIG. 18 is a perspective view illustrating the using state of the display unit; and FIG. 19 is a perspective view illustrating the main portion of the display unit. In these figures, referring to the commodity display unit 101 wherein the lots of rollers 11 are mounted on the frontal advancing frame 1*i* and the commodities 53 on the rollers 11 are moved toward the commodity take-out section A, the display unit 101 comprises: a commodity frontal advancing device 6 having the side panel 15 so mounted on the frontal advancing frame 1*i* as to partition the frame 1*i* parallel to the front-to-back direction and thereby guide the commodities; and the slide fixing plate for positioning 7 designed to determine a distance between the side panels 15 conformably to the wide length of the commodity and to connect the frontal advancing devices 6 to one another and fix their positions, wherein the slide fixing plate for positioning 7 and the frontal advancing devices 6 are fitted to each other to form one united body.

In the forward delivery rail frame 1*i*, an outside frame 19*c* positioned at the commodity take-out section A and the other outside frame 19*d* opposite thereto are fitted to both ends of two outside frames 19*a* and 19*b* each diminishing in width toward the commodity take-out section A, and the upper end surfaces of the two outside frames 19*a* and 19*b* decline from the side panel 19*d* to the side panel 19*c*. The lower end surface of the side panel 19*a* is trenched to form concave grooves 14*b* between which a convex portion 14*a* is provided so as to form a jagged engagement section. The side panel 15, mounted on the frame 1*i* as above, partitions the frame 1*i* at a slightly deviated position to the left as illustrated in FIGS. 17 and 18 instead of equally partitioning it parallel to the longitudinal direction of the frame 1*i*.

Then, the lots of rollers 11 are rotatably disposed between the side panel 15 and the outside frame 19*a* and between the side panel 15 and the outside frame 19*b* respectively along the upper end surfaces of the outside frames 19*a* and 19*b* each declining toward the take-out section A. Accordingly, the commodities on the lots of rollers 11 move toward the take-out position A owing to the constant applied component of force derived from the deadweight of the commodities. In FIG. 18, the symbol 23 denotes the commodity fall-down preventing panel, which serves to prevent the commodities from toppling or dropping and is held by a holding device 121.

Figure 20:
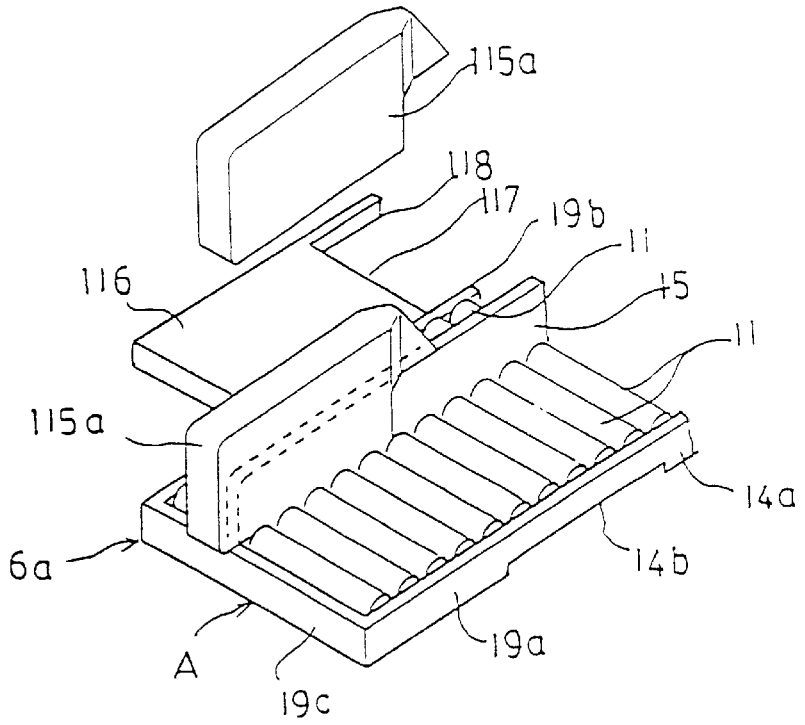
FIG. 20 is a perspective view showing another of the part of a commodity display unit in FIG. 19.

A width adjustment spacer 115 is provided in the end portion, located at the take-out position, of the side panel 15 so as to form one united body therewith. The spacer 115 is formed to correspond to at least one commodity. This is arranged because the sizes of the commodities are different according to the kind thereof and the width adjustment spacers 115 have to sandwich one commodity therebetween in order to determine the best distance between the side panels 15 and position the commodity advancing devices 6 together. Furthermore, the thickness of the spacer 115 is determined by seeing what is required of the clearance between the side panel 15 and the commodity 53 in order to move most smoothly the commodities 53 on the plurality of rollers 11 between the side panels (partition) 15 each having no spacer 115 toward the take-out section A. That is, the thickness of the spacer 115 is fixed based on experiments and empirical rules relating to all kinds of commodities. The spacer 115*a* may be detachably set in the end portion of the side panel 15 as shown in FIG. 20. Such a spacer 115*a* can conveniently provide the advancing device 6*a* having no width adjustment function with such a function.

The slide fixing plate for positioning 7 comprising a rectangular notch 117 formed in a horizontal plate 116 and a hook section 118 positioned in the notch 117, is fitted to the elongate outside frame 19*b* of the rail frame 1*i* of the frontal advancing device 6 so as to form one united body therewith. The rectangular notch 117 and the horizontal plate 116 of the slide fixing plate for positioning 7 are enabled to engage with the concave groove 14*b* formed in the lower end surface of the outside frame 19*a* of the rail frame 1*i*, and the hook section 118 is permitted to engage with the convex portion 14*a* between the grooves 14*b*, thus defining the maximum width of the commodity 53 allowed to be laid between the frontal advancing devices 6.

Next, the usage method of the commodity display unit 101 constituted as above is explained. First, there are prepared a necessary number of the commodity display units 101 each obtained by fitting the slide fixing plate for positioning 7 to the outside frame 19*a* of the frontal advancing device 6 for united one body. That is, at least two or more display units 101 with which the respective spacers 115 are united are prepared, or else the detachable spacers 115 and the display units 101 each comprising the frontal advancing device 6*a* having no width adjustment function are prepared, Subsequently, the two or more display units 101 are received and placed on the commodity display shelf 51 shown in FIG.

Figure 21:
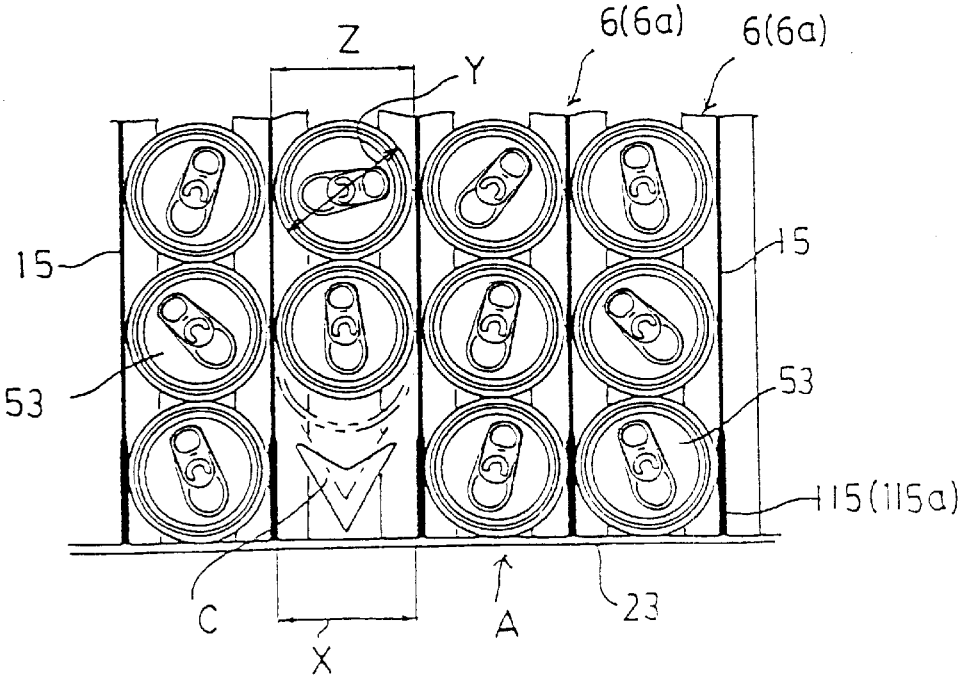
FIG. 21 is a partial plan view showing a commodity display unit in the using state.

27 in such a manner that the outside frame 19*c* of the frontal advancing device 6 faces to the door 55. The commodity frontal advancing device 6*a* in FIG. 20 becomes similar to the device 6 by fitting the spacer 115*a* into the end portion of the side panel 15 of the device 6*a*. The positioning of the frontal advancing devices 6 is conducted by: engaging the slide fixing plate for position 7 of one frontal advancing device 6 with the other frontal advancing device 6; placing the commodities 53 on the lots of rollers 11 between the width adjustment spacers 115 of the two devices 6; and moving the two devices 6 fitted into the slide fixing plate for positioning 7 until the spacer 115 contacts lightly with the commodity 53, thus easily carrying out the positioning, connecting the two devices 6 to each other, and fixing the devices at the positions. In the case of placing additional commodities 53, it has only to be needed to add the display units 101 to the above in sequence and conduct the same work as above on each occasion. As illustrated in FIG. 21, on removing the commodities 53 in this state, the width length X between the width adjustment spacers 115 is nearly equal to the width length Y of the commodity 53; the width length Z between the side panels 115 is appropriately larger than the width length Y of the commodity 53 ($X \approx Y < Z$); the length between the side panels 115 is set optimum; hence, on taking out the commodity 53, the following commodities 53 are guided by the side panels 15 each having no spacer 115; and then the forefront commodity 53 moves until it contacts with the commodity fall-down preventing panel 23.

Figure 22:
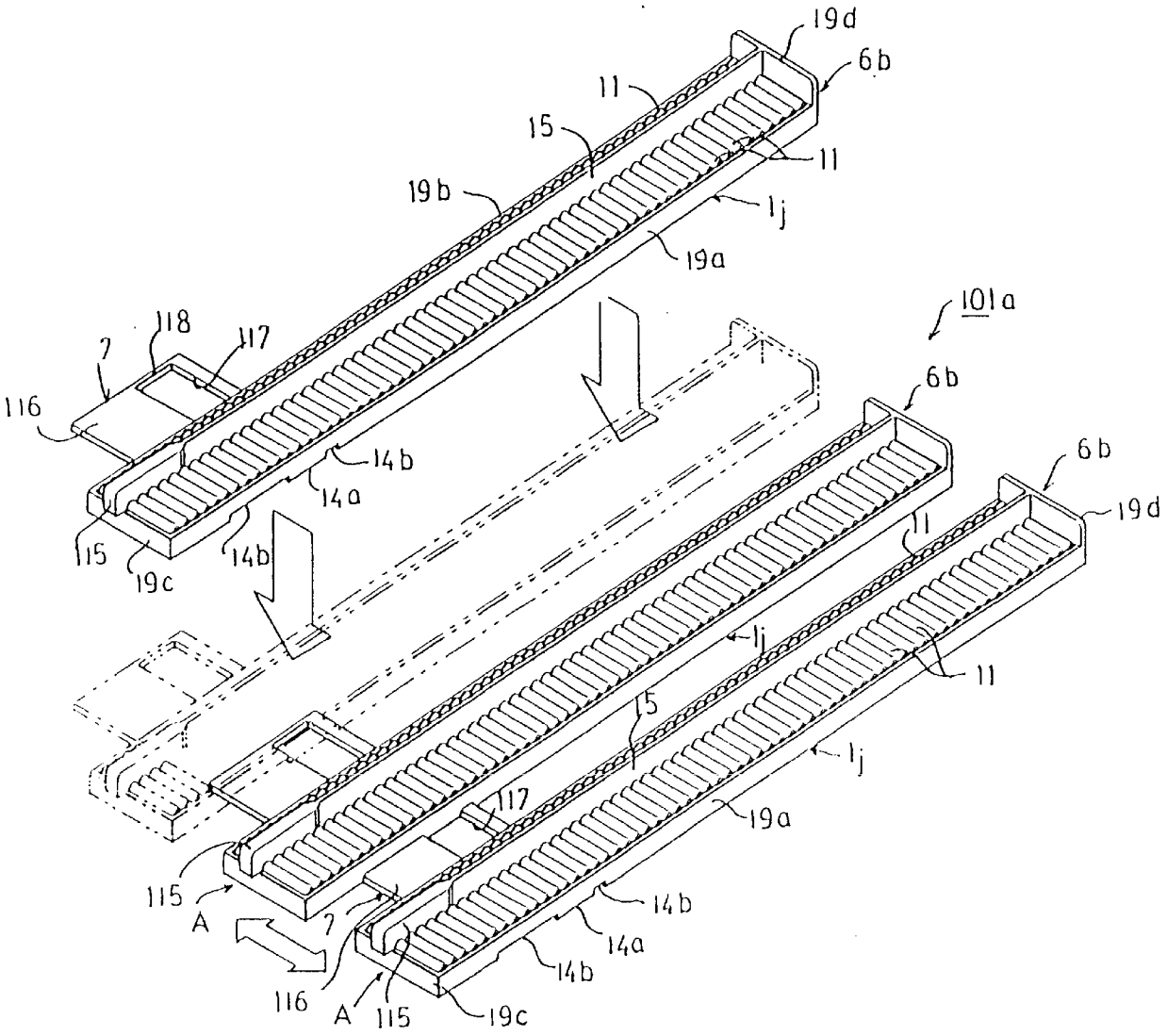
FIGS. 22 through 26 are perspective views showing the assembling states of commodity display units in other embodiments according to the present invention, respectively.

FIG. 22 shows the commodity display unit 101*a* of another embodiment of the present invention, and what is different from the unit 101 in FIG. 17 through FIG. 21 is as follows: the lots of rollers 11 are nearly horizontally mounted on the frontal advancing rail fame 1*j* of the frontal advancing device 6*b*; when used, the rail frame 1*j* is declined toward the commodity take-out section A, thus allowing the angle of inclination of the lots of rollers 11 to be freely set according to the state of the commodities 53; on mounting the frame 1*j*, as it is, on the commodity display shelf 51 or the like shown in FIG. 27, the commodities 53 on the lots of rollers 11 can be moved toward the take-out section A by the constant applied component of force derived from the deadweight of the commodities 53 in compliance with the state of the commodities 53. Other constitutions and functions are similar to those of the commodity display unit 101 illustrated in FIG. 17 through FIG. 21, and hence the explanation is omitted while affixing the related symbols on the figures.

Figure 23:
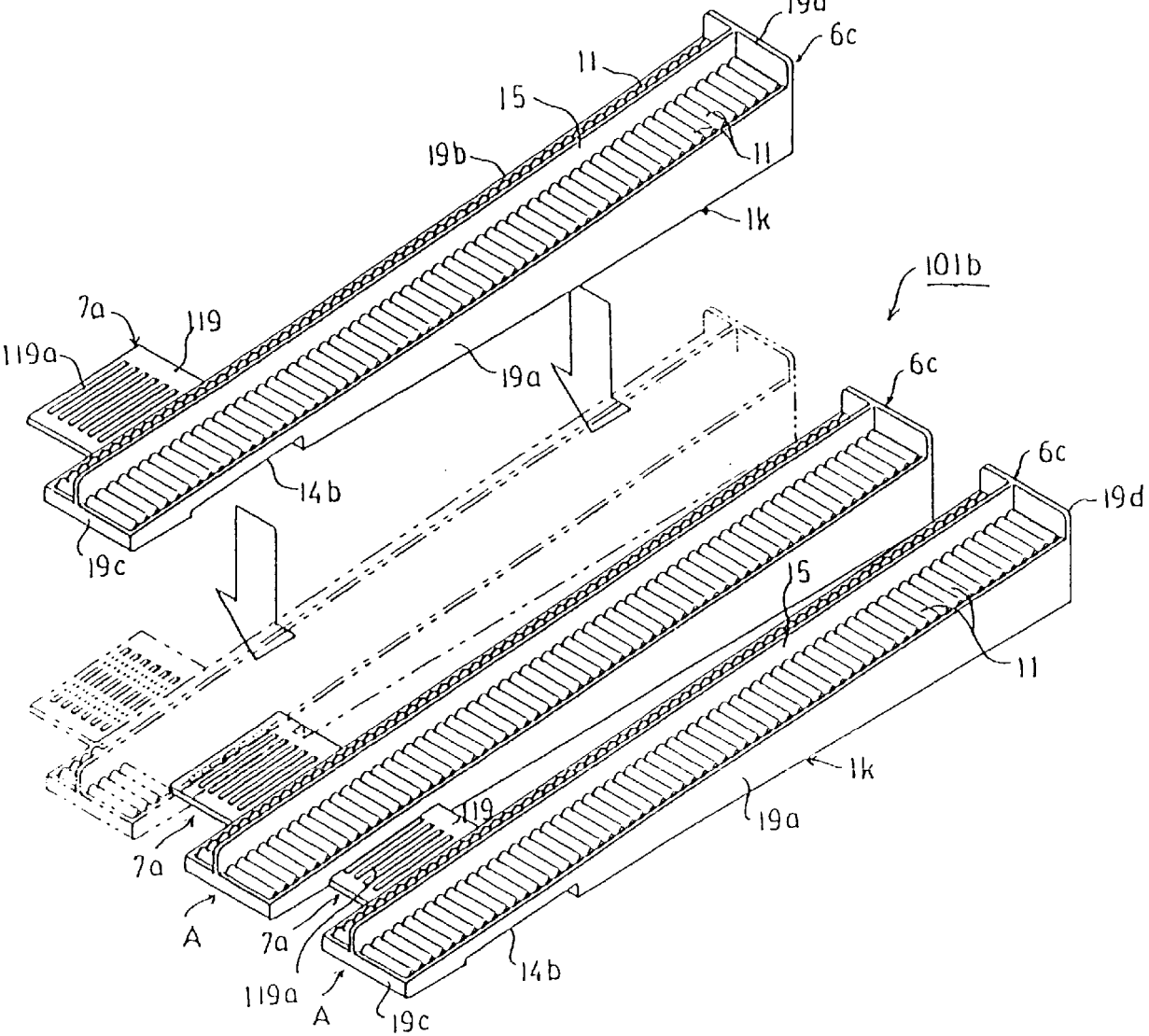

FIG. 23 shows the commodity display unit 101*b* of another embodiment of the present invention, and what is different from the unit 101 in FIG. 17 through FIG. 21 is as follows: the pitch fixing plate 7*a* for positioning, formed in one united body with the commodity frontal advancing device 6*c*, is provided with a positioning pitch plate 119 designed to define a distance between the side panels 15; hence, the projections (not shown) of the concave grooves 14*b* are fitted into the pitches 119*a* of the pitch plate 119 while conforming the devices 6*c* together to the size of the commodity 53; and then surely conducting the connection between the devices 6*c* and the positioning thereof. Incidentally, this commodity display unit 101*b* does not bear the width adjustment spacer 115 because the pitches 119*a* of the pitch plate 119 serve to define the distance between the side panels 15 to resultantly dispense with the spacers. Other constitutions and functions are similar to those of the commodity display unit 101 illustrated in FIG. 17 through FIG. 21, and hence the explanation is omitted while affixing the related symbols on the figures.

Figure 24:
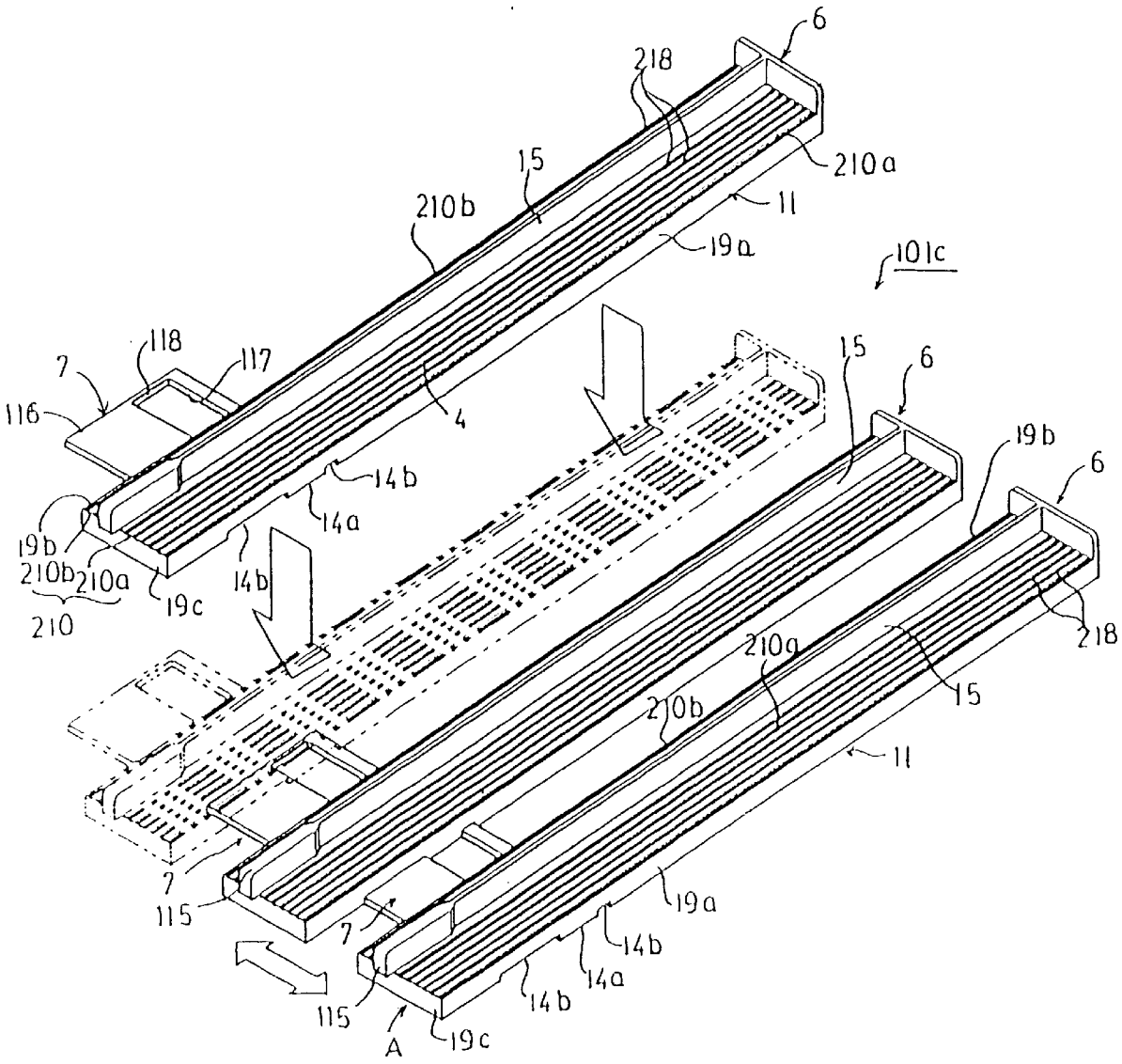

FIG. 24 illustrates the commodity display unit 101*c* in another embodiment of the present invention, what is different from the display unit 101*a* shown in FIG. 22 is that a ribby slide material 218 replaces the lots of rollers. That is, in the figure, the upper plate 210 of the frontal advancing frame 1*l* separates into the upper plate 210*a* of the outside frame 19*b* and the upper plate 210*b* of the outside frame 19*c* through the intermediary of the side plate 15 as a boundary. The ribby slide material 218 is nearly horizontally applied onto the upper plates 210*a* and 210*b*, the frontal advancing rail frame 1*l* is declined toward the commodity take-out section A when used. There exist no limits to the ribby slide material 218, however, whose coefficient of friction $\mu$ preferably approximates to zero as much as possible, needless to say. Accordingly, on selecting the material 218 with a coefficient of friction $\mu$ equivalent to the rolling friction of the lots of rollers 11 used in the previous embodiments and then slanting this rail frame 1*l* at the same inclination of angle, the commodities 53 on the material 218 moves toward the frontal take-out section A by the constant applied component of force derived from the deadweight, similarly to the previous embodiment using the rollers 11.

Figure 25:
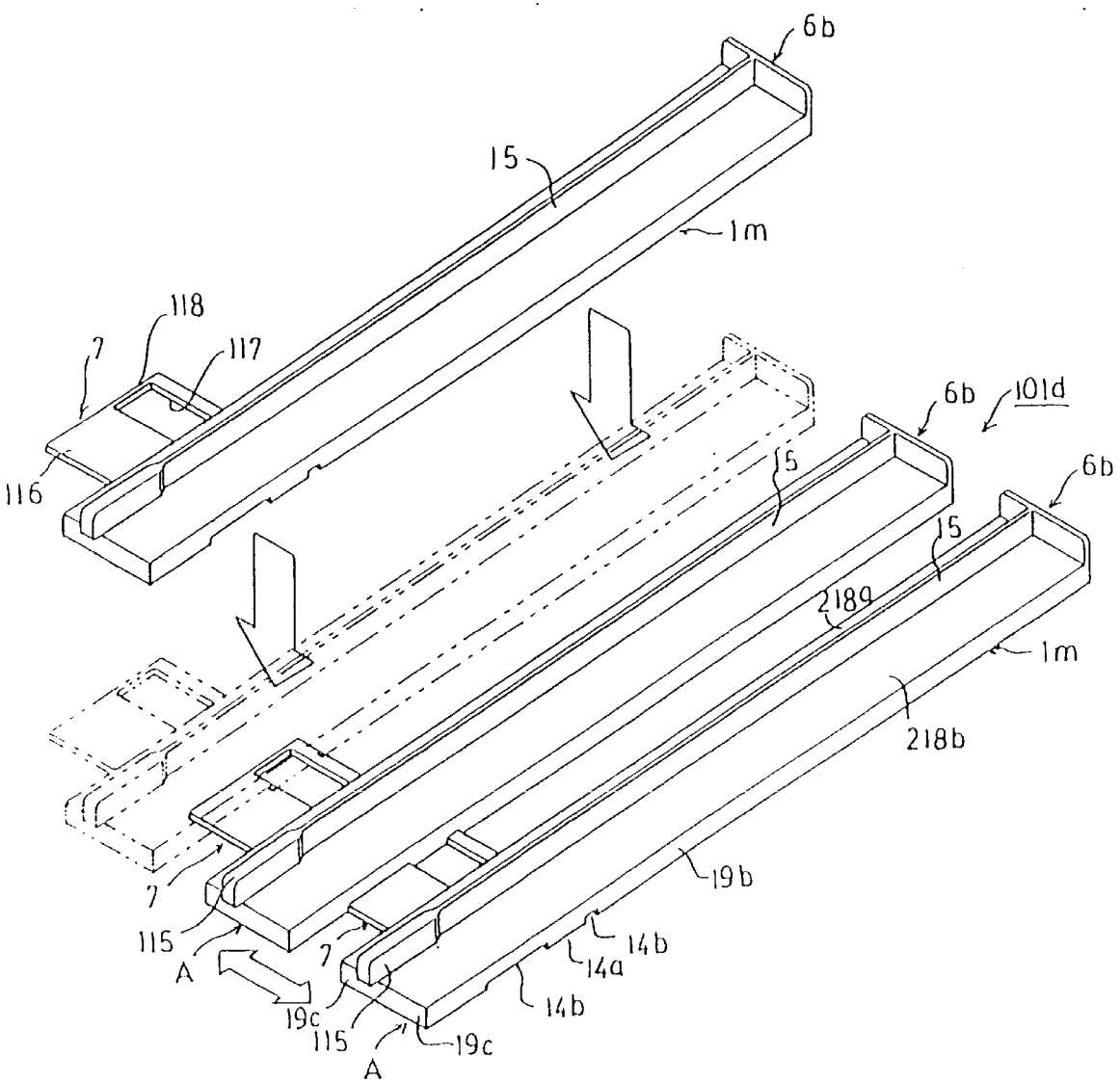

As for FIG. 25, the same components as those of FIG. 24 are denoted by the same symbols and omitted in explanation, and then only the difference therebetween is described next. Namely, in the embodiment of FIG. 25, what is different from the embodiment in FIG. 24 is that a planate slide material 218*a* replaces the ribby slide material. There exist no limits to the planate slide material 218*a*, and what is obtained by applying a lubricant to the surface of the upper plate 210 may be acceptable.

Figure 26:
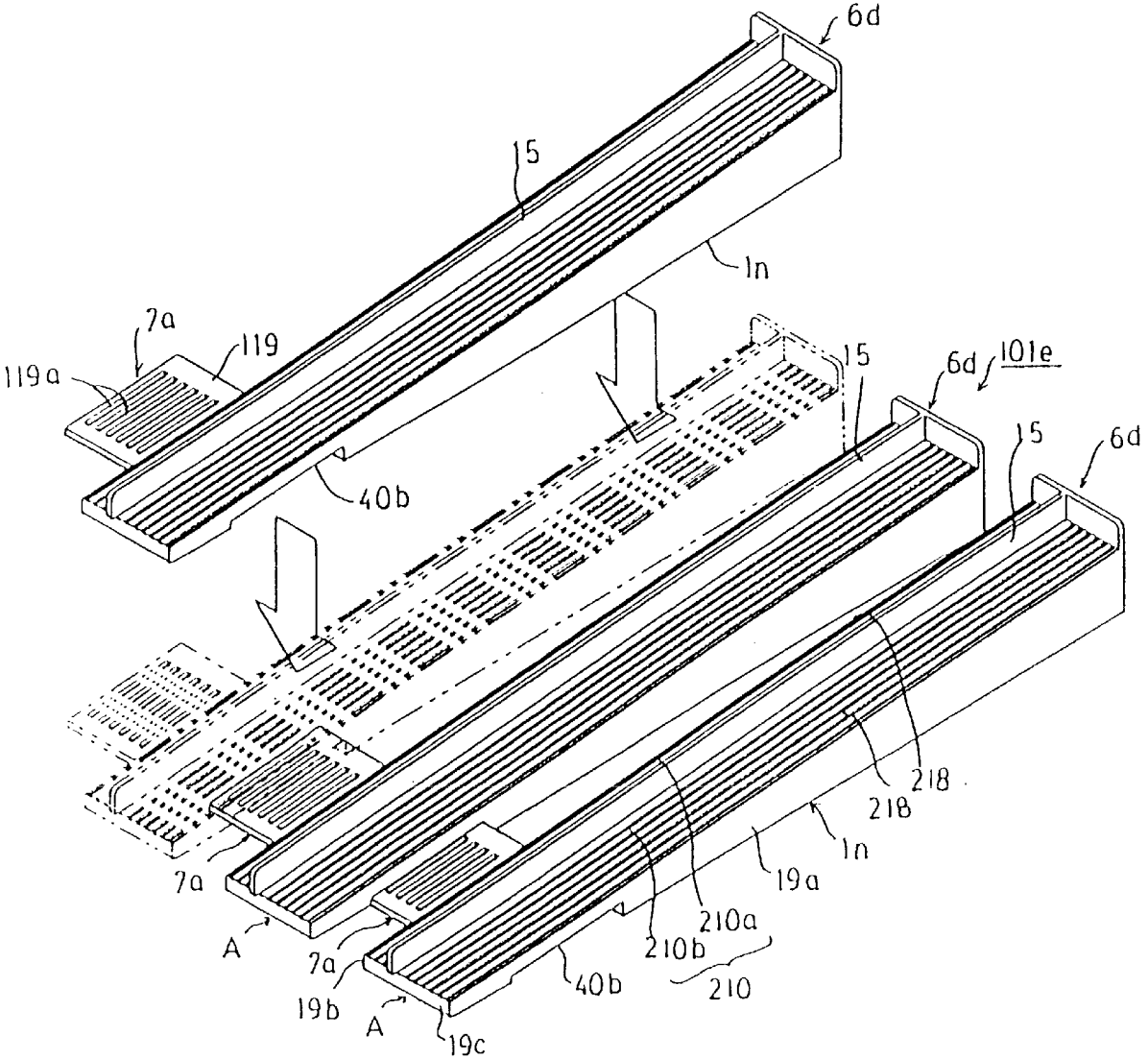

As for FIG. 26, the same components as those of FIG. 23 are denoted by the same symbols and omitted in explanation, and then only the difference therebetween is described next. Namely, in the embodiment of FIG. 26, what is different from the embodiment in FIG. 23 is that the ribby slide material 218 replaces the lots of rollers. In the figure, the constitution of the ribby slide material is similar to that in FIG. 24. Also, in the present invention, it may be possible that the frontal advancing rail frame 1 is separated into two sections by using the side panel 15 as a boundary; the slide material is nearly horizontally applied onto one section and the rollers is nearly horizontally applied onto the other section; and then the frontal advancing rail frame is slant toward the commodity frontal take-out section.

Figure 27:
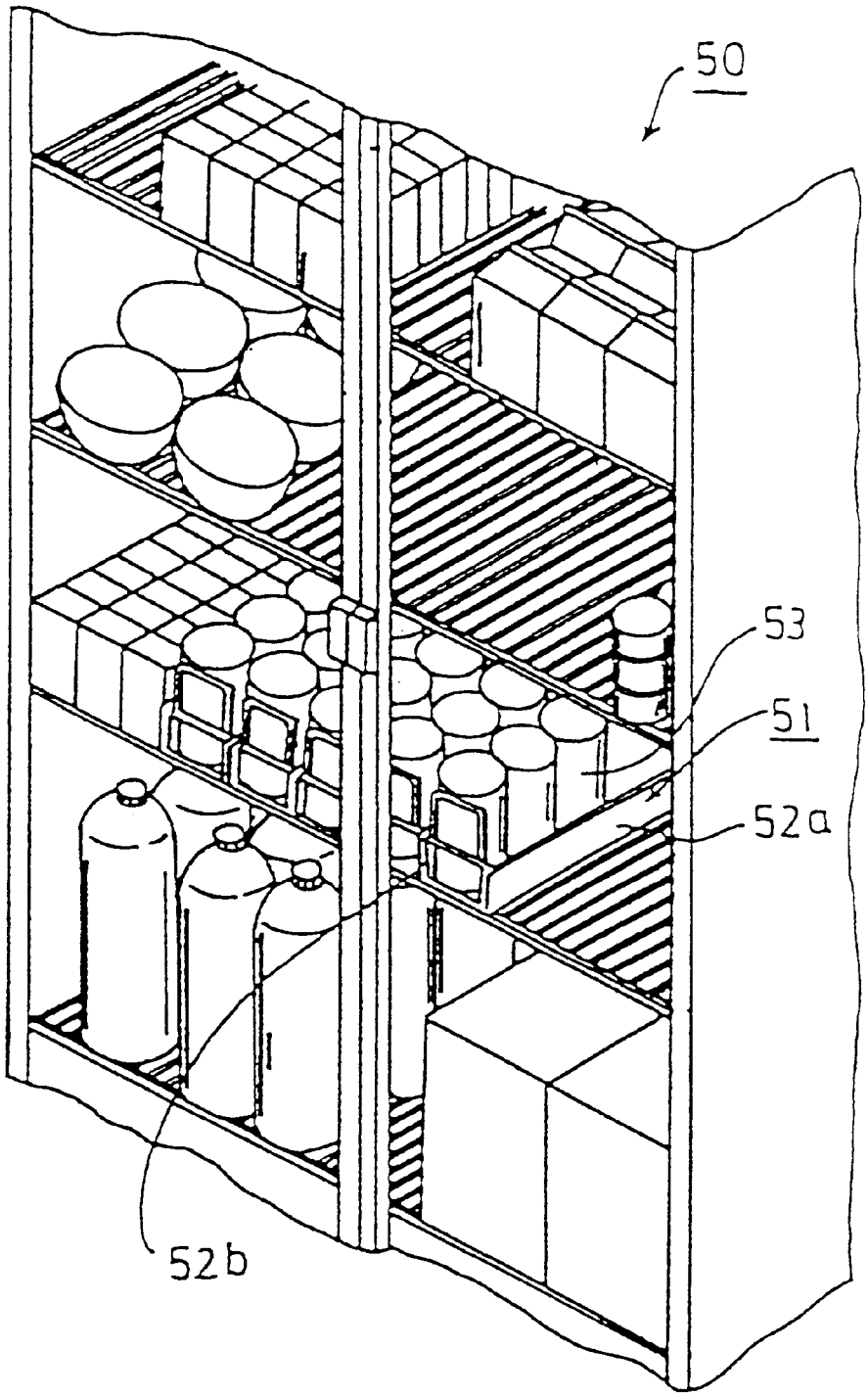
FIG. 27 is a view showing one embodiment of a commodity display case adapted to employ a commodity display unit according to the present invention.

There are no limits to the display shelf where the commodity display unit of the present invention is used, and it may be exemplified by: the display shelf of the commodity display case 50 as shown in FIG. 27; and horizontal shelves, sloping shelves or the like of the gondola or the like in supermarkets, drugstores or the like.

INDUSTRIAL APPLICABILITY

According to the present invention, by fitly combining two or more of the frontal rail frames with one another, a commodity display space conformable to the size of the commodity to be displayed is provided, and simultaneously the resultant frontal advancing rail frames are set in the form of sloping down frontward. From this, the side panel of one frontal advancing rail frame provides a partition along one side of the commodities; the side panel of another frontal advancing rail frame provides a partition along the other side of the commodities; and hence the two rail frames enable a column of commodities to be frontally advanced while keeping it in the form of being displayed. Especially, the positioning slide plate makes it possible to delicately set the width while mounting the commodities on the frontal advancing rail frame. Also, the inventory management is easy and the design change can be readily made according to e.g. the size of the commodity to be displayed. Regarding to such a commodity not to need to contact with the rollers in the middle portion between the side panels, e.g., a canned product having its broad bottom, it is allowed to install the two frontal advancing rail frames in the form of being separated from one another, hence it is possible to thin out the slide material e.g. the rollers and make the commodity display unit inexpensive. Furthermore, even a vertically long product having a center of gravity highly positioned is unlikely to drop frontward. Thus, the commodity can be automatically advanced from the front side of the unit irrespective of its size; naturally, the frontal rail frames corresponding to a variety of commodity sizes never need to be kept in stock; the design is easily changeable without being restricted by the commodity size; and then any inventory management is hardly needed because of a simply structured and unitedly formed product. Also, according to the present invention, the most suitable positioning for smooth frontal advancing is conducted by only contacting lightly the width adjustment spacer fitted in the side panel (partition) of the frontal advancing frame with the commodity so as to determine a distance between the side plates and by connecting the rail frames as it is to one another via the positioning and fixing device. Therefore, in addition to the above advantage, the most suitable positioning can be easily completed according to the commodity size; the commodity can be smoothly, surely and automatically advanced frontally without being damaged; and then it becomes possible to effectively utilize the space within e.g. the commodity display case because of dispensing with such a positioning as to need an excessive space.

What is claimed is:

1. A commodity display unit comprising:

at least two adjacent forward delivery rail frames, each having a plurality of rollers mounted thereon and inclined downwardly;

at least two adjacent side panel sections, one of each being disposed in a middle portion of each of the rail frames and configured to guide therebetween a plurality of commodities over a space separating the two adjacent rail frames; and at least two end plates, one of each being disposed on each of the side panel sections and being positioned at a rear part of the rail frames;

wherein a distance between the two adjacent side panel sections is adjustable to accommodate a width of the plurality of commodities being guided therebetween over the space separating the two adjacent rail frames by moving at least one of the two adjacent rail frames laterally towards or away from the other of the two adjacent rail frames.

2. A commodity display unit according to claim 1, further comprising:

a pitch-fixing plate configured to position the rail frames at a selected angle of inclination, said pitch-fixing plate being provided as a single integral body.

3. A commodity display unit according to claim 1, further comprising:

a commodity fall-prevention panel disposed at a front part of the rail frames and provided with an engagement groove.

4. A commodity display unit according to claim 1, wherein:

said plurality of rollers is mounted on each of the rail frames and is inclined downwardly by mounting the plurality of rollers substantially horizontally on each of the rail frames and by inclining each of the rail frames downwardly towards a commodity take-out section when the rail frames are in use.

5. A commodity display unit according to claim 1, wherein:

said plurality of rollers moves along a sliding surface of each of the rail frames.

6. A commodity display unit comprising:

at least two adjacent forward delivery rail frames, each having a plurality of rollers mounted thereon and inclined downwardly;

at least two adjacent side panel sections, one of each being disposed in a middle portion of each of the rail frames and configured to guide therebetween a plurality of commodities over a space separating the two adjacent rail frames;

a jagged engagement section provided on a bottom of each of the rail frames; and a slide plate being configured to position one of the two rail frames discrete from another one of the rail frames and having an engagement section which slidably engages with the jagged engagement section;

wherein a distance between the two adjacent side panel sections is adjustable to accommodate a width of the plurality of commodities being guided therebetween over the space separating the two adjacent rail frames by moving at least one of the two adjacent rail frames.

7. A commodity display unit according to claim 6, further comprising:

at least two end plates, one of each being disposed on each of the side panel sections and being positioned at a rear part of the rail frames.

8. A commodity display unit according to claim 6, further comprising:

a commodity fall-prevention panel disposed at a front part of the rail frames and provided with an engagement groove.

9. A commodity display unit according to claim 6, wherein:

said plurality of rollers is mounted on each of the rail frames and is inclined downwardly by mounting the plurality of rollers substantially horizontally on each of the rail frames and by inclining each of the rail frames downwardly towards a commodity take-out section when the rail frames are in use.

10. A commodity display unit according to claim 6, wherein:

said plurality of rollers moves along a sliding surface of each of the rail frames.

* * * * *